United States Patent [19]

Kimpara

[11] Patent Number: 4,932,303

[45] Date of Patent: Jun. 12, 1990

[54] PERCUSSION TYPE ELECTRONIC MUSICAL INSTRUMENT HAVING REDUCED ABNORMAL VIBRATION TONE GENERATION

[75] Inventor: Mamoru Kimpara, Hamamatsu, Japan

[73] Assignee: Yamaha Corporation, Hamamatsu, Japan

[21] Appl. No.: 287,454

[22] Filed: Dec. 19, 1988

[30] Foreign Application Priority Data

Dec. 29, 1987 [JP] Japan ..... 62-332268
Dec. 29, 1987 [JP] Japan ..... 62-332269
Dec. 29, 1987 [JP] Japan ..... 62-332270

[51] Int. Cl.[5] ..... G10H 3/14; G10H 5/00; G10H 7/00

[52] U.S. Cl. ..... 84/621; 84/691; 84/723; 84/DIG. 12

[58] Field of Search ..... 84/1.01, 1.03, 1.19–1.28, 84/621, 691, DIG. 12, DIG. 24, 723–734

[56] References Cited

U.S. PATENT DOCUMENTS 4,662,261 5/1987 Akutzu ..... 84/1.01
4,672,876 6/1987 Sugiyama et al. .
4,773,294 9/1988 Iizuka et al. ..... 84/1.01

*Primary Examiner*—Stanley J. Witkowski

*Attorney, Agent, or Firm*—Spensley Horn Jubas & Lubitz

[57] ABSTRACT

An electronic musical instrument includes a performance operating member, a performance operation detection unit, a self vibration detection data forming unit, a tone generation control unit, and a tone signal generator. The performance operation detection unit forms performance operation detection data corresponding to an operation amount of the performance operating member. When the performance operation detection data of the performance operating member is obtained, the self vibration detection data forming unit forms self vibration detection data determined by a performance operation mounted based on previous performance operation detection data obtained by a previous performance operation of the performance operating member and by a first lapse time interval from when previous performance operation detection data were obtained until a present time. The tone generation control unit compares the performance operation detection data at the present time with the self vibration detection data, and forms, based on the comparison result, tone generation data representing whether or not tone generation is made. The tone signal generator performs a tone generation operation of a musical tone in response to the tone generation data.

13 Claims, 18 Drawing Sheets

KTABLE

| PADNO \ MINPD | 1 | 2 | 3 | --- | 6 |
|---|---|---|---|---|---|
| 1 | — | K12 | K13 | --- | K16 |
| 2 | K21 | — | K23 | --- | K26 |
| 3 | K31 | K32 | — | --- | K36 |
| ⋮ | ⋮ | ⋮ | ⋮ | ⋱ | ⋮ |
| 6 | K61 | K62 | K63 | --- | — |

DCTBL

| DATA GROUP | ADVAL \ 15-LAPCTR | 1 | 2 | 3 | --- | 14 |
|---|---|---|---|---|---|---|
| DCTBL (30) | 30 | DV 3001 | DV 3002 | DV 3003 | --- | DV 3014 |
| DCTBL (29) | 29 | DV 2901 | DV 2902 | DV 2903 | --- | DV 2914 |
| ⋮ | ⋮ | ⋮ | ⋮ | ⋮ | ⋱ | ⋮ |
| DCTBL (10) | 10 | DV 1001 | DV 1002 | DV 1003 | --- | DV 1014 |

DMTBL

| PADNO \ MINPD | 1 | 2 | 3 | --- | 6 |
|---|---|---|---|---|---|
| 1 | — | D12 | D13 | --- | D16 |
| 2 | D21 | — | D23 | --- | D26 |
| 3 | D31 | D32 | — | --- | D36 |
| ⋮ | ⋮ | ⋮ | ⋮ | ⋱ | ⋮ |
| 6 | D61 | D62 | D63 | --- | — |

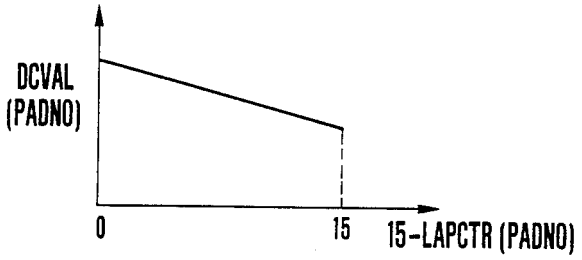
FIG.20
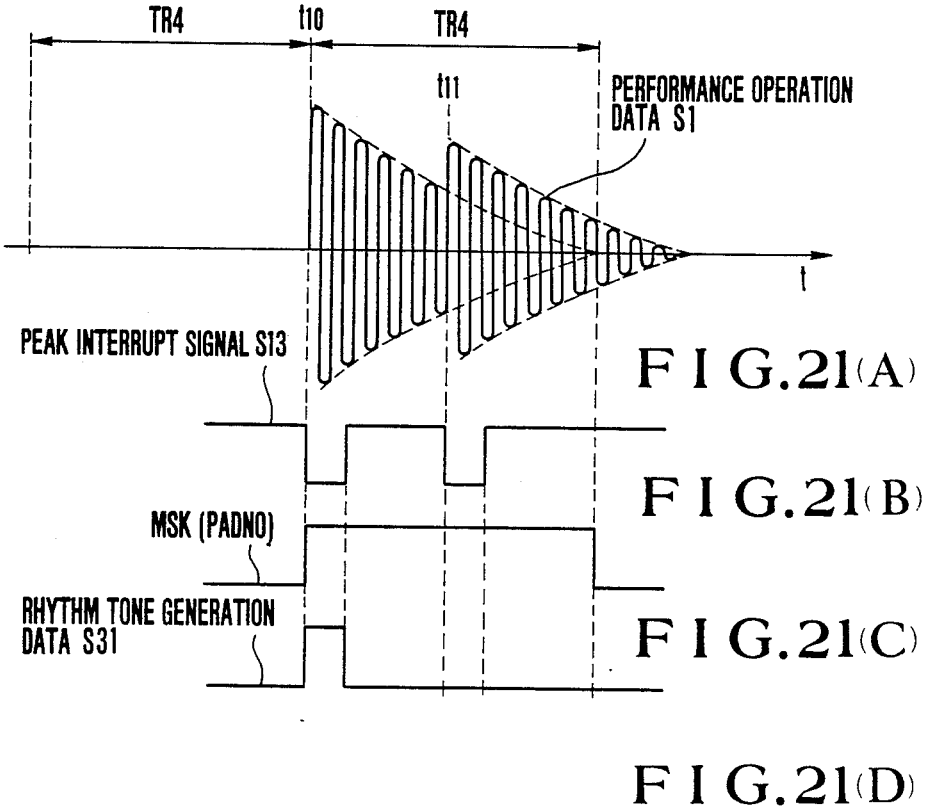
FIG.21(A)
FIG.21(B)
FIG.21(C)
FIG.21(D)

PERCUSSION TYPE ELECTRONIC MUSICAL INSTRUMENT HAVING REDUCED ABNORMAL VIBRATION TONE GENERATION

BACKGROUND OF THE INVENTION

The present invention relates to an electronic musical instrument and, more particularly, to an electronic musical instrument such as an electronic percussion, which detects a performance operation based on an operation amount, e.g., a vibration amount representing a strength, speed, depth, and the like of a performance operating member, e.g., a string or a drum pad.

As shown in FIG. 23, an electronic percussion 1 of this type has pads PAD1 to PAD6 as six performance operating members 3 which are arranged on a board 2. When a performer strikes one of the pads PAD1 to PAD6 with a stick, the corresponding one of the pads PAD1 to PAD6 generates performance operation data such as striking strength, speed, depth, and the like based on a vibration in accordance with its performance operation amount, and the performance operation data is converted to electrical performance operation detection data. Then, a percussion tone assigned to the corresponding one of the pads PAD1 to PAD6 is produced in accordance with a tone generation condition set by various setting operating members on a setting operation unit 4.

For example, as percussion tones, a bass drum tone, cymbal tone, snare drum tone, high hat open tone, and high hat close tone can be respectively assigned to the pads PAD1 to PAD6.

When the performance operating members 3 operated by the performer have relatively large operation surfaces like the pads PAD1 to PAD6, and the performer strongly strikes one (e.g., pad PAD1) of the pads PAD1 to PAD6, the corresponding pad PAD1 is vibrated (this is called a "self vibration"). Thus, operation data such as an operation strength can be inputted, and the remaining pads PAD2 to PAD6 arranged on the board 2 are vibrated upon influence of the vibration of the pad PAD1 (this is called a "parasitic vibration").

In practice, the following technique can be employed. In order to accurately detect a performance operation state of the pads PAD1 to PAD6 based on such a vibration, an envelope signal J2 shown in FIG. 24B is formed based on a vibration detection signal J1 shown in FIG. 24A. When a peak value appears in the envelope signal J2, it is determined that the performance operation is made, and a performance operation data fetch signal J3 is generated as shown in FIG. 24C.

However, when performance operation data is obtained by this technique, if the pads PAD1 to PAD6 are abnormally strongly struck, the vibration detection signal J1 does not have a waveform which has only on peak and is naturally attenuated, and an abnormal vibration detection signal J1X which generates second and third peaks following the first peak may be generated.

In this case, every time a peak value appears in the abnormal vibration detection signal J1, a performance operation data fetch signal J3X is generated, and an abnormal musical tone is generated. Thus, the musical tone may become unnatural.

Assume that a conventional electronic percussion is struck using a stick in practice, for example, that a performer holds sticks with his hands and strikes the pads PAD1 to PAD6. In this case, if the performer strikes one pad with one stick, and immediately thereafter (after the lapse of a very short period of time), strikes the same pad with the other stick (i.e., he successively strikes the same pad), in order to strike the corresponding pad thereafter, i.e., to perform a performance operation of a third strike, he must release one or both the sticks from the pad from a state wherein the sticks are in contact with the surface of the pad.

In the electronic percussion, when the same pad is successively struck twice, if a percussion tone is produced during a time interval from the timing of the second strike until the stick is returned to an original position, the produced tone inevitably sounds unnatural.

When a drum or cymbal as an acoustic percussion is struck with two sticks, no tone is generated between the second and third strike timings. However, in the electronic percussion, if a musical tone which does not maintain the above-mentioned time interval is produced, it is discriminated as an unnatural percussion tone.

The above-mentioned parasitic vibration occurs if the pads PAD1 to PAD6 are a drum, cymbal, and the like as acoustic percussions, and it is undesirable to prevent a parasitic vibration in comparison with the acoustic percussions.

Considering a drum set as an acoustic percussion, if one percussion, e.g., a bass drum is struck by a beater, since the vibration of the struck vibration skin head has considerably large energy, other drums and cymbals cause the parasitic vibration. As a result, the produced tone can be listened to as a synthesized performance tone of the drum set including a state wherein a plurality of percussions are vibrated by the parasitic vibration.

SUMMARY OF THE INVENTION

The present invention has been made in consideration of the above situation, and has as its object to provide an electronic musical instrument which, when an abnormal self vibration occurs, can reliably discriminate it and can prevent an unnatural musical tone from being produced.

It is another object of the present invention to provide an electronic musical instrument which, when the same operating member is successively struck twice, can prevent an unnatural musical tone from being produced as a following percussion tone.

It is still another object of the present invention to provide an electronic musical instrument, which, when one of a plurality of performance operating members is operated, can generate a synthesized percussion tone like an acoustic percussion so as not to sound unnatural.

In order to achieve the above object, according to an aspect of the present invention, there is provided an electronic musical instrument comprising a performance operating member, performance operation detection means for forming performance operation detection data corresponding to an operation amount of the performance operating member, means for, when the performance operation detection data of the performance operating member is obtained, forming self vibration detection data determined by a performance operation amount based on previous performance operation detection data obtained upon a previous performance operation of the performance operating member and by a first lapse time interval from when previous performance operation detection data are obtained until a present time, tone generation control means for comparing the performance operation detection data at the present time with the self vibration detection data, and forming, based on the comparison result, tone generation data representing whether or not tone generation is made, and tone generation means for performing a tone generation operation of a musical tone in response to the tone generation data.

According to another aspect of the present invention, there is provided an electronic musical instrument comprising at least two performance operating members, performance operation detection means for detecting performance operation detection data corresponding to operation amounts of the performance operating members in units of the performance operating members, holding means for, when first performance operation detection data is detected from one performance operating member, holding the first performance operation detection data until second performance operation detection data is obtained from the other performance operating member, tone generation control means for forming special tone generation data when the first performance operation detection data held in the holding means is obtained a predetermined period of time before the second performance operation detection data is obtained and if a first performance operation amount obtained from the second performance operation detection data and a second performance operation amount obtained by the first performance operation detection data held in the holding means have a predetermined relationship, and tone generation means for generating a musical tone corresponding to the special tone generation data.

BRIEF DESCRIPTION OF THE DRAWINGS

FIG. 20 is a graph showing another embodiment of self vibration detection data;

FIGS. 21A–D and 22 are waveform charts and a flow chart, respectively for explaining another embodiment of an electronic musical instrument according to the present invention;

DESCRIPTION OF THE PREFERRED EMBODIMENTS

An embodiment of the present invention will now be described in detail with reference to the accompanying drawings.

[1] Arrangement of First Embodiment

Figure 2:
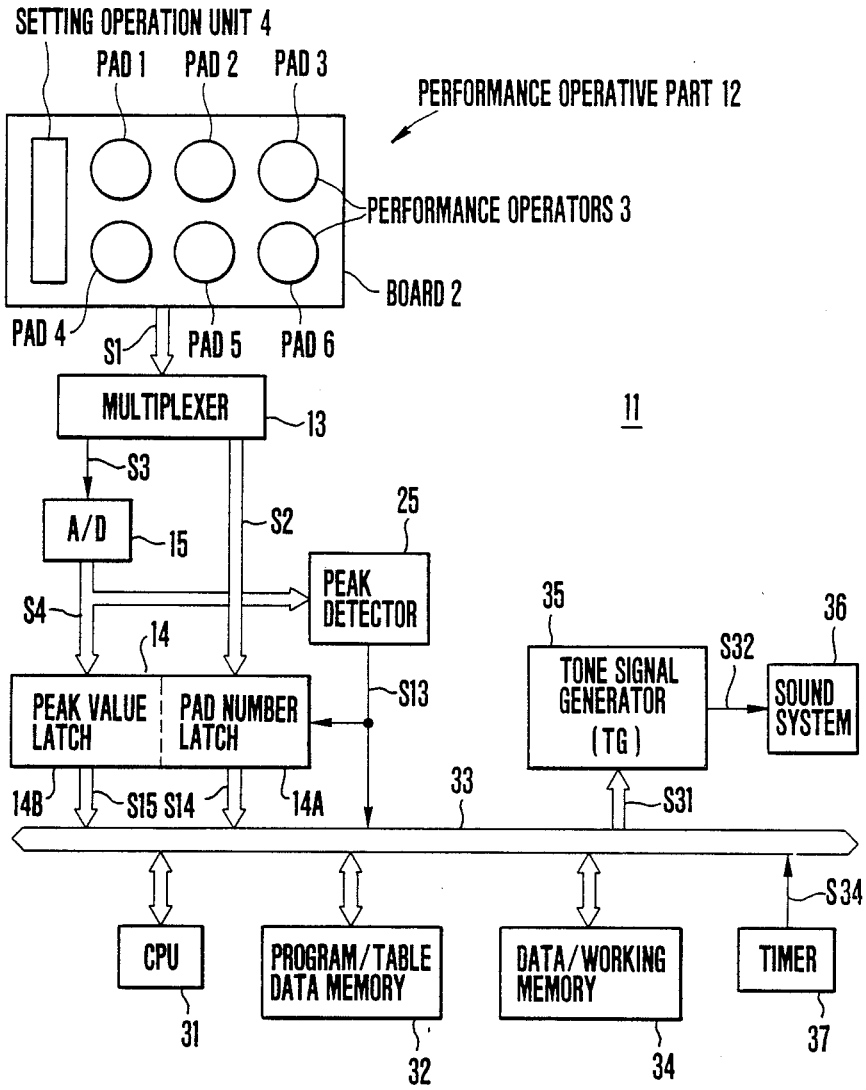
FIG. 2 is a block diagram showing the overall arrangement of a first embodiment.
Figure 3:
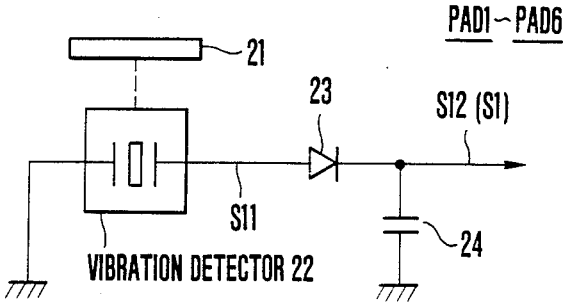
FIG. 3 is a circuit diagram showing an output circuit of performance operation data of pads PAD1 to PAD6 shown in FIG. 2.
Figure 23:
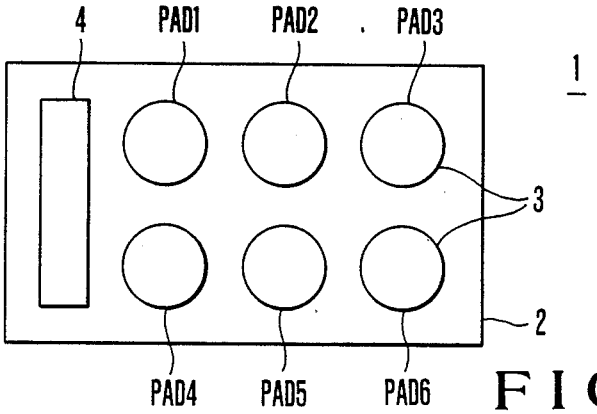
FIG.23 PRIOR ART
FIG. 23 is a schematic plan view showing an arrangement of a conventional electronic percussion.

FIG. 2 shows an embodiment wherein the present invention is applied to an electronic percussion as an electronic musical instrument. An electronic percussion 11 has a performance operation unit 12 having the same arrangement as the performance operation unit of the electronic percussion 1 described above with reference to FIG. 23 (the same reference numeral in FIG. 2 denotes the same parts as in FIG. 23).

When one of pads PAD1 to PAD6 as performance operating members 3 arranged on a board 2 is struck with sticks, a corresponding performance operation data signal S1 is outputted to a multiplexer 13.

The multiplexer 13 supplies a pad number signal indicating a struck pad number of the performance operation data signal S1 to a pad number latch 14A of a latch register 14, and supplies a performance operation amount signal S3 representing a strength, speed, and the like of the performance operation with respect to the corresponding one of the pads PAD1 to PAD6 to a peak value latch 14B of the latch register 14 through an analog-to-digital (A/D) converter 15 as performance operation amount data S4.

Figure 4A:
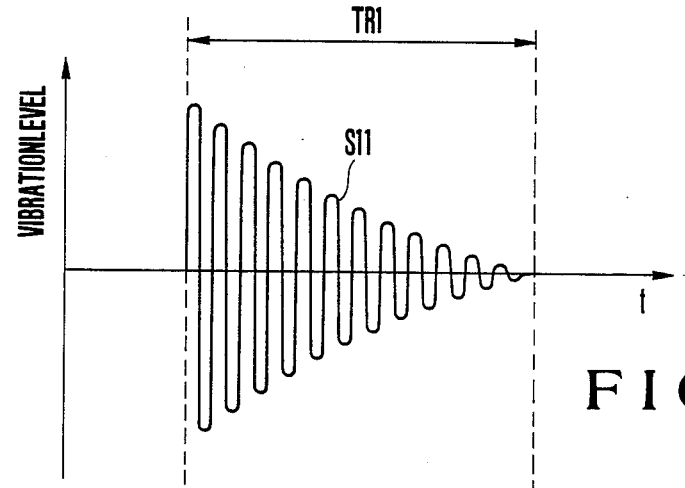
FIGS. 4A, 4B are waveform charts of signals of the respective sections shown in FIG. 3.
Figure 4B:
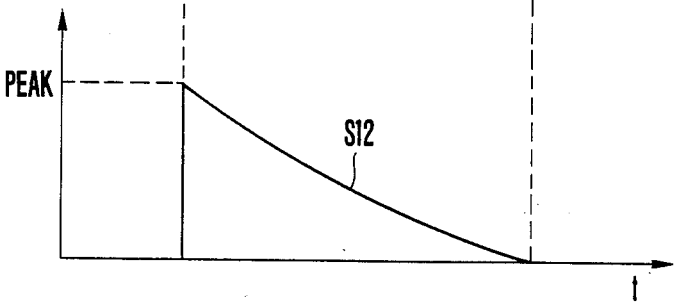

Each of the pads PAD1 to PAD6 converts a vibration of a pad vibrator 21 into a vibration signal S11 (FIG. 4A) by a vibration detector 22 such as a piezoelectric sensor, conductive rubber, or the like, and smooths the vibration signal S11 by a diode 23 and a capacitor 24 to convert it into a vibration envelope signal S12 (FIG. 4B). Then, the pad outputs the signal S12 as the performance operation data S1 (FIG. 2).

The performance operation amount data S4 output from the A/D converter 15 is supplied to a peak detector 25. When the vibration envelope signal S12 (FIG. 4B) reaches a peak value PEAK, the peak detector 25 generates a peak interrupt signal S13 as detection timing data, and supplies it to the latch register 14 as a latch signal. In this case, the latch register 14 latches the performance operation amount data S4 in the peak value latch 14B, and latches the pad number signal S2 in the pad number latch 14A.

The pad number data S14 and the peak value latch data S15 respectively latched by the pad number latch 14A and the peak value latch 14B, and the peak interrupt signal S13 outputted from the peak detector 25 are fetched in a data/working memory 34 comprising a RAM through a bus 33 and are subjected to calculation processing together with table data stored in a program/table data memory 32 when a central processing unit (CPU) 31 executes a program stored in the program/table data memory 32 comprising a ROM.

The CPU 31 supplies the calculated data to a tone signal generator (TG) 35 as a rhythm tone source through the bus 33 as rhythm tone generation data S31. The tone signal generator (TG) 35 sequentially receives the rhythm tone generation data S31 about a maximum number of percussion tones (in this case, six tones) in time slots assigned to first to sixth tone generation channels, and outputs a tone signal S32 representing a corresponding rhythm tone to a sound system 36. In this manner, the tone signal S32 is converted to a percussion tone in the sound system 36.

Figure 6:
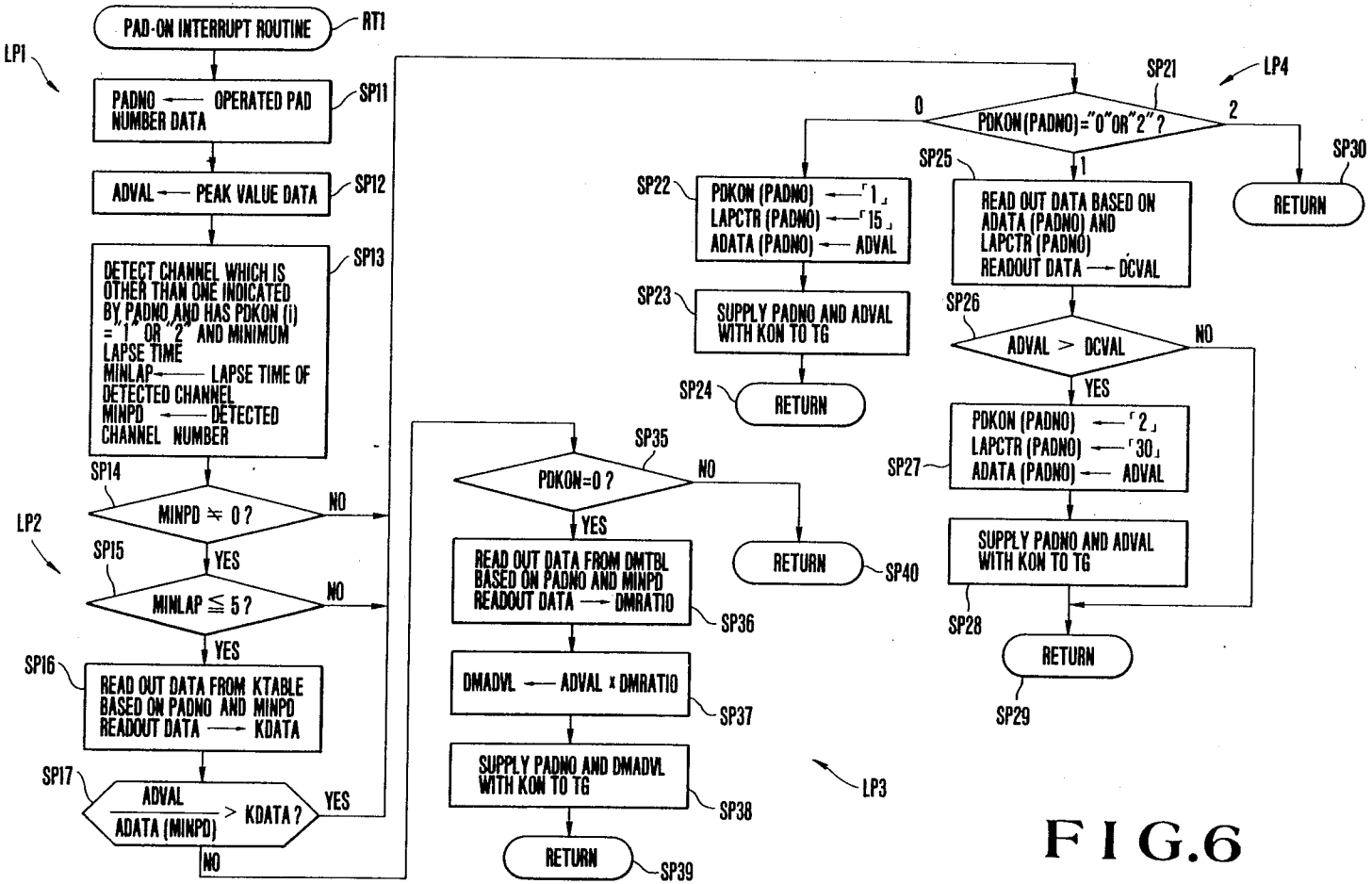
FIG. 6 is a flow chart showing a pad-on interrupt routine.

When a performer strikes one of the pads PAD1 to PAD6 as the performance operating members 3 at a present time $t_0$, the CPU 31 fetches and calculates data based on the performance operation data signal S1 in the register 34A (FIG. 5) of the data/working memory 34 by executing a pad-on interrupt routine RT1 shown in FIG. 6 every time the peak interrupt signal S13 is generated.

Figure 7:
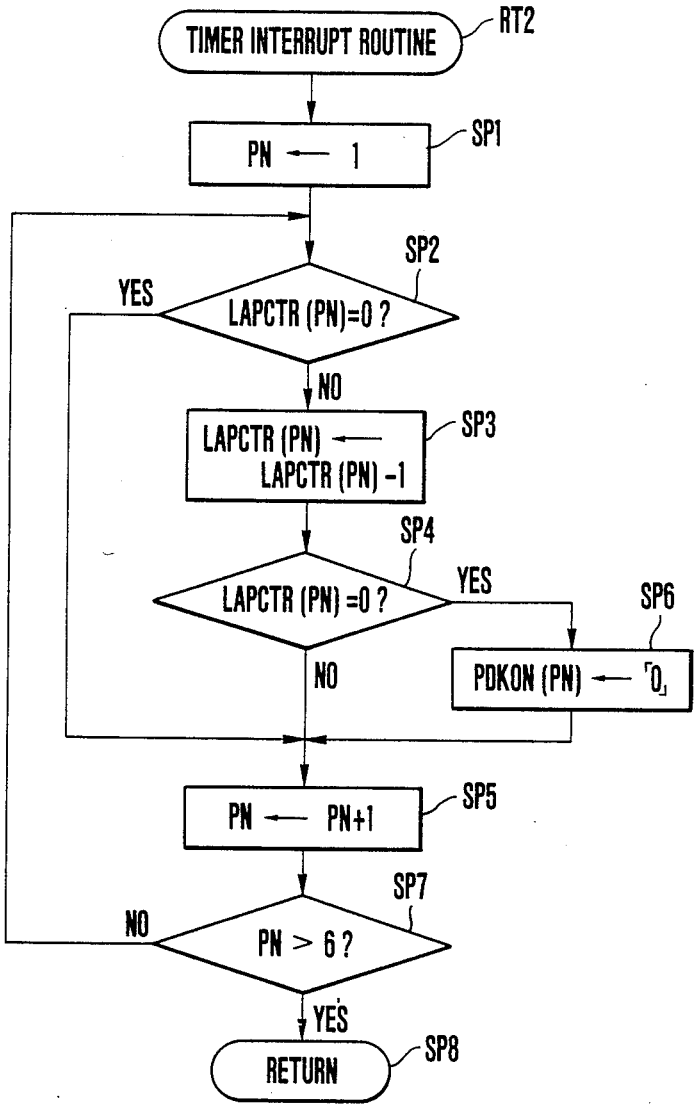
FIG. 7 is a flow chart showing a timer interrupt routine.

A lapse of time of the previous performance state is discriminated by executing a timer interrupt routine RT2 shown in FIG. 7 by the CPU 1 every time a timer interrupt signal S34 is generated from an interrupt timer 37.

Figure 5:
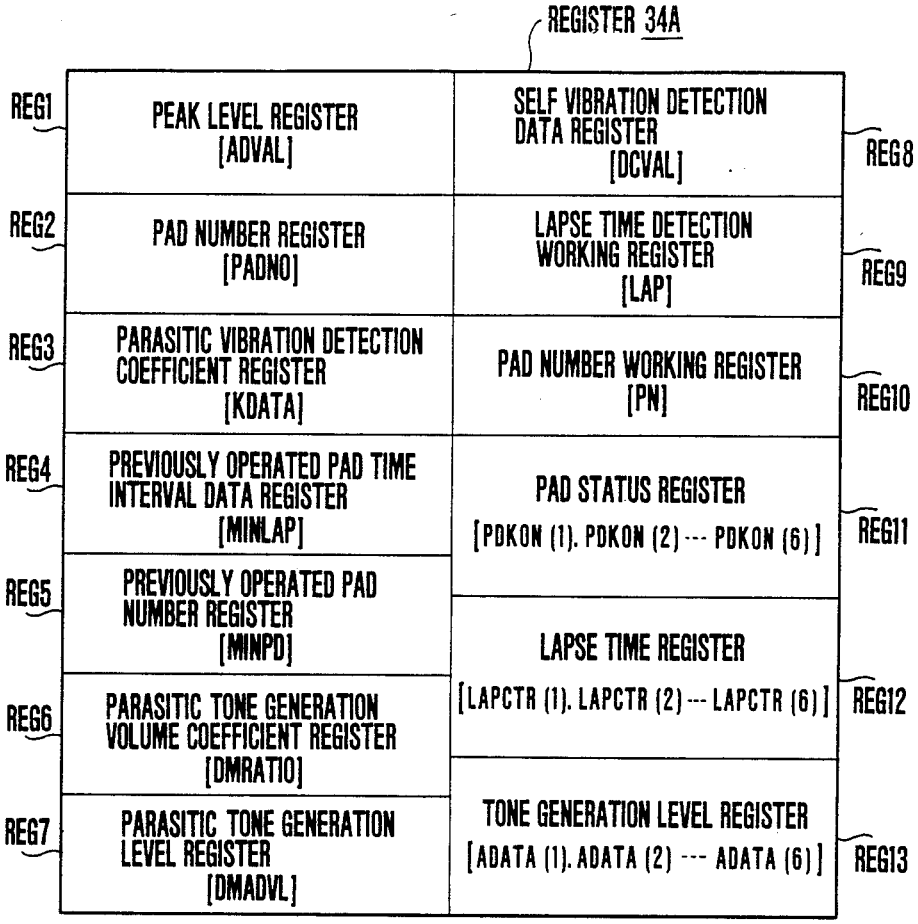
FIG. 5 is a table showing a detailed format of a register provided to a data/working memory 34 shown in FIG. 2.

In this embodiment, the CPU 31 classifies the previous performance states of the pads PAD1 to PAD6 into three states, e.g., status "0", status "1", and status "2", and stores the status data as pad status data PDKON(i) (i=1, 2, . . . , 6) corresponding to the pads PAD1 to PAD6 in a pad status register REG11 constituting the register 34A of the data/working memory 34, as shown in FIG. 5.

Figure 8:
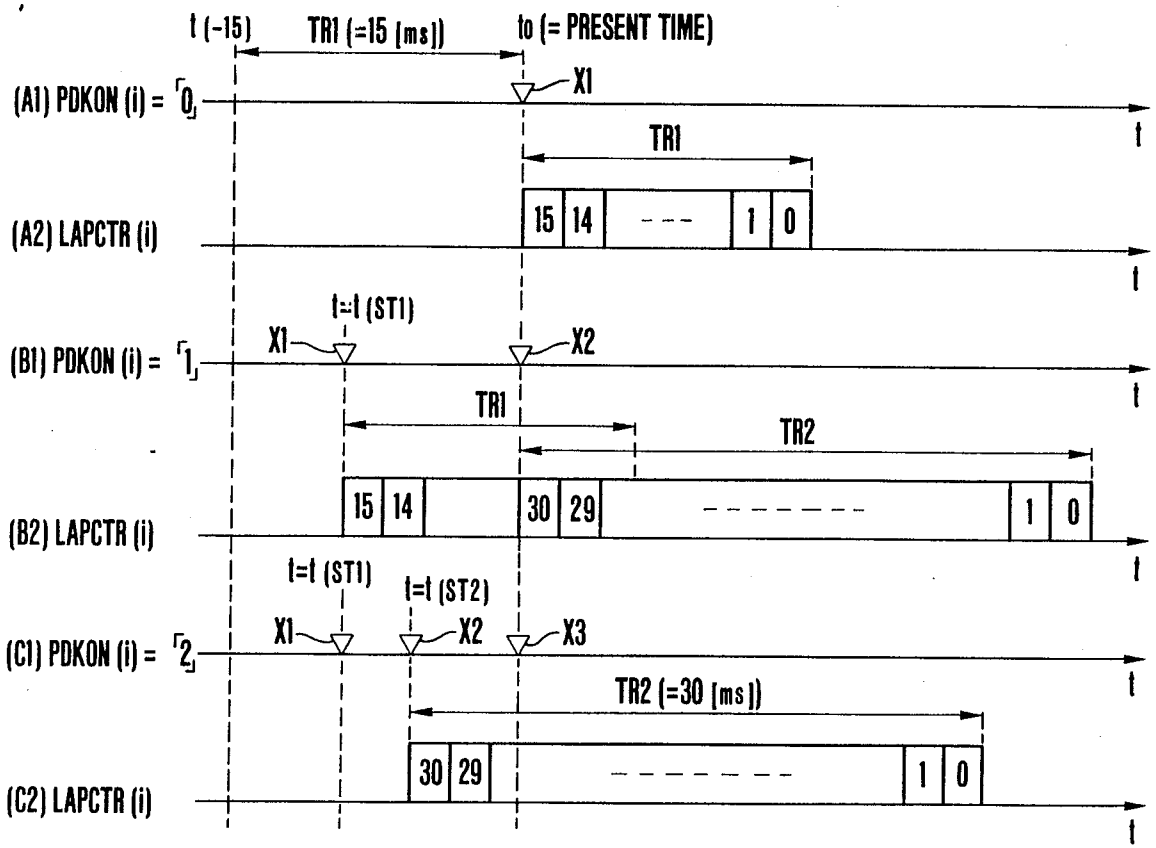
FIG. 8 is a timing chart for explaining a basic control method of a CPU 31 shown in FIG. 2.

The state of status "0" is a state wherein an ith pad was not struck during a first reference time interval TR1 (e.g., 15 ms) between a previous time $t_{(-15)}$ and the present time $t_0$, as shown in (A1) of FIG. 8. In this state, a performance operation is made at the present time $t_0$, as indicated by reference symbol X1 in FIG. 8.

In the state of status "0", the tone generation operation can be performed whenever the performance operation is made. In this case, the CPU 31 presets a numerical value "15" representing the first reference time interval TR1 as lapse time data LAPCTR(i) (i=1, 2, . . . , 6) held in a lapse time register REG12 (FIG. 5), as shown in (A2) of FIG. 8, and decrements the lapse time data LAPCTR(i) (i=1, 2, . . . , 6) by one every 1 ms, thus counting the first reference time interval TR1.

The first reference time interval TR1 is selected to be a sufficient time interval (e.g., 15 ms) from when a vibration starts upon operation of the pads PAD1 to PAD6 until the vibration terminates, as shown in FIG. 4A.

The state of status "1" is a state wherein a first performance operation is made as indicated by reference symbol X1 at a time $t=t_{(ST1)}$ other than the time $t_{(-15)}$ the first reference time interval TR1 before the present time $t_0$, as shown in (B1) of FIG. 8, and thereafter, a second performance operation is made at the present time $t_0$ as indicated by reference symbol X2.

This state means the pad which is struck first at the time $t=t_{(ST1)}$ and generates a vibration is subjected to the second performance operation before its vibration state is not yet terminated. This state is established when the performer successively strikes a certain pad with sticks held by his hands within a short period of time.

In this case, a time interval longer than a predetermined time interval is required from when a stick which strikes a pad is released from the pad surface until it strikes the pad surface again, and it can be regarded as an erroneous operation that a percussion tone is generated from the sound system 36 before the re-performance time.

In this case, as shown in (B2) of FIG. 8, a second reference time interval TR2 (30 ms in this embodiment) is counted as lapse time data LAPCTR(i) from the present time $t_0$ at which the second performance operation is made, and during the second reference time interval TR2 as a rest period, the tone generation operation of the tone signal generator (TG) 35 is inhibited.

In the state of status "2", as shown in (C1) of FIG. 8, when a vibration equivalent to a third performance operation is caused at the present time $t_0$, as indicated by reference symbol X1, after the same pad was successively struck twice at times $t=t_{(ST1)}$ and $t=t_{(ST2)}$ other than the time $t_{(-15)}$ the first reference time interval TR1 before the present time $t_0$, as indicated by reference symbols X1 and X2, since the lapse time data LAPCTR(i) in the lapse time register REG12 is being subjected to a count operation of the second reference time interval TR2 ((C2) of FIG. 8), the CPU 31 controls to inhibit the tone generation operation.

[2] Principle Processing Sequence 1

A processing sequence for achieving the first object, i.e., for preventing a self vibration, will be briefly described below.

Figure 1A:
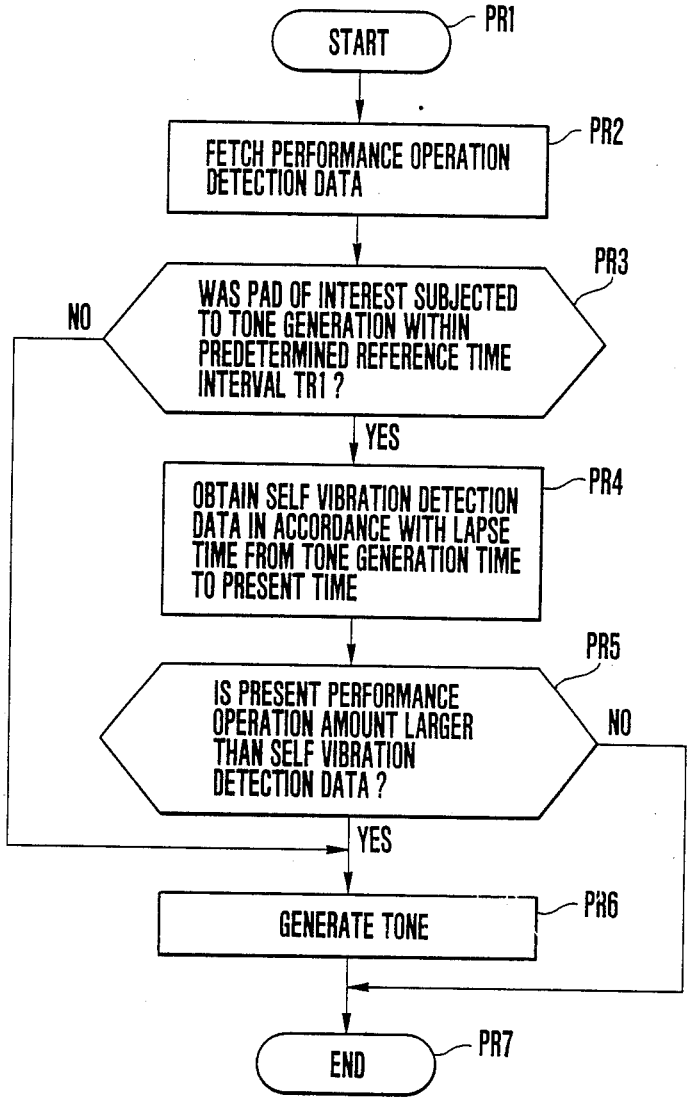
FIGS. 1A to 1C are flow charts showing principle processing sequences in an embodiment of an electronic musical instrument according to the present invention.

In the embodiment shown in FIG. 2, the CPU 31 checks in accordance with the principle processing sequence shown in FIG. 1A based on performance operation detection data obtained at the present time $t_0$ whether or not the tone generation operation is performed.

When the peak interrupt signal S13 is generated by one of the pads PAD1 to PAD6 constituting the performance operating members 3, the CPU 31 enters the tone generation confirmation processing routine from step PR1, and fetches performance operation detection data (that is, the pad number latch data S14 and peak value latch data S15) from the corresponding pad which generates a peak value in step PR2.

The CPU 31 checks in step PR3 if a tone is generated within a predetermined reference time interval, i.e., the first reference time interval TR1. If YES in step PR3, the flow advances to step PR4 to obtain self vibration detection data in accordance with a lapse time period from the previous tone generation time to the present time $t_0$.

Figure 24A:
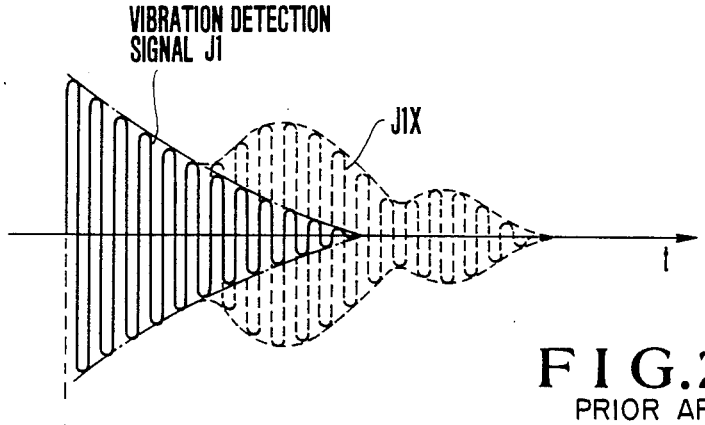
FIG.24(A) PRIOR ART
FIGS. 24A–C are waveform charts for explaining an abnormal vibration.
Figure 24B:
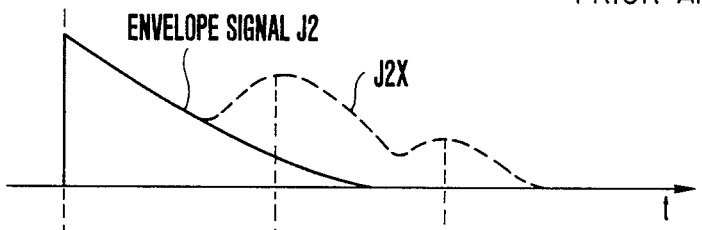
FIG.24(B) PRIOR ART
Figure 24C:
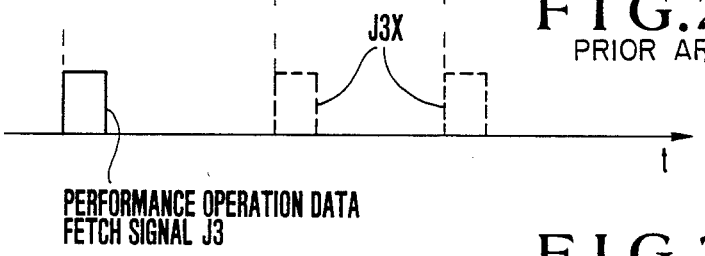
FIG.24(C) PRIOR ART

The self vibration detection data is preset to be a value with which the following decision can be made. That is, in consideration of the performance operation amount of the previous performance operation and the lapse time period to the present time, the performance operation amount at the present time $t_0$ is not based on a self vibration caused by a new performance operation, but the peak interrupt signal is generated since a variation occurs due to the previous abnormal performance to cause an envelope to be deviated from a normal attenuation curve in an attenuation process of a vibration, as has been described with reference to FIG. 24A–C.

Since the vibration of a pad is gradually attenuated along with the lapse of time, as represented by the vibration detection signal J1 as shown in (A) in FIG. 24, the self vibration detection data for determining whether or not an abnormal vibration occurs is selected to draw a curve which is decreased along with the lapse of time from the previous tone generation time to the present time $t_0$.

The CPU 31 checks in step PR5 if the performance operation amount at the present time is larger than the self vibration detection data.

If YES in step PR5, this means that the presently detected performance operation amount is larger than the self vibration detection data, and hence, is based on a regular performance operation. In this case, the flow advances to step PR6, and the CPU 31 causes to generate a musical tone. In step PR7, the tone generation confirmation processing routine is ended.

If NO in step PR5, this means that the present performance operation amount is generated not based on the regular performance operation. In this case, the CPU 31 jumps tone generation processing in step PR6, and ends the tone generation confirmation processing routine in step PR7.

If NO in step PR3, this means that since a time interval from the previous performance operation to the present time $t_0$ is longer than the reference time interval TR1, an abnormal vibration based on the previous performance operation need not be monitored (in other words, it can be determined that the present performance operation amount is based on the regular performance operation).

Therefore, in this case, the CPU 31 does not execute the tone generation confirmation processing in steps PR4 and PR5, and the flow jumps to step PR6 to execute tone generation processing based on the corresponding performance operation detection data.

The principle processing sequence shown in FIG. 1A is embodied in a pad-on interrupt routine TR1 shown in FIG. 6.

[3] Principle Processing Sequence 2

A processing sequence for achieving the second object, i.e., for preventing generation of an unnatural tone when the same operating member is successively struck twice, will be briefly described below.

Figure 1B:
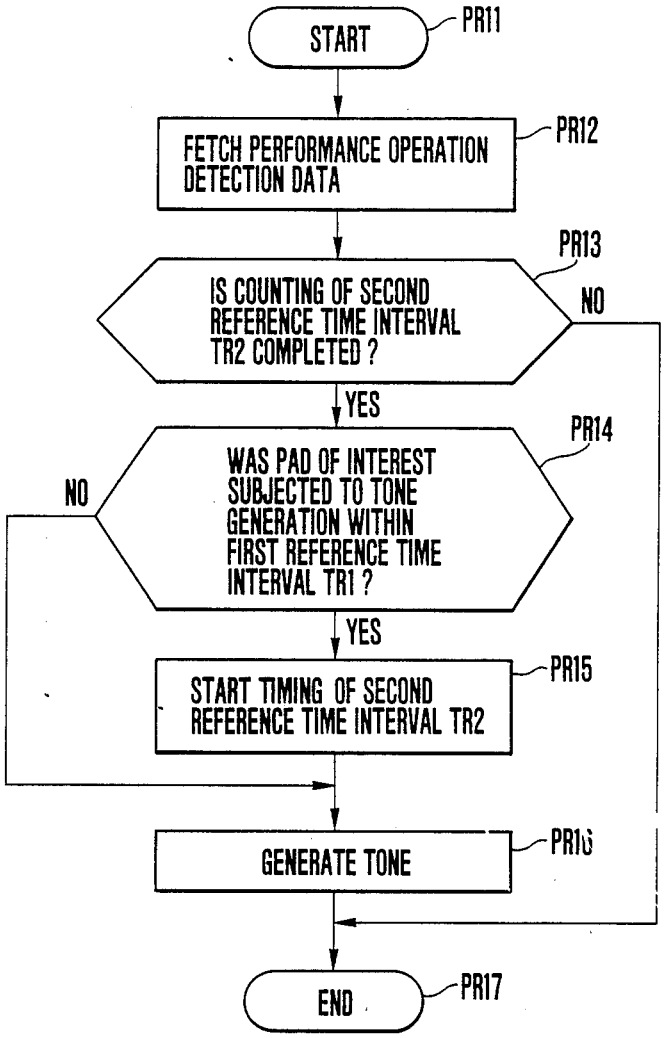

In the embodiment shown in FIG. 2, the CPU 31 executes tone generation inhibition processing for inhibiting subsequent tone generation when the same pad is successively struck, in accordance with the principle processing sequence shown in FIG. 1B.

When the peak interrupt signal S13 is generated from one of the pads PAD1 to PAD6 constituting the performance operating members 3, the CPU 31 enters the tone generation inhibition processing routine from step PR11, and fetches the performance operation detection data in step PR12 (that is, the pad number latch data S14 and the peak value latch data S15) from the corresponding pad which generates a peak value.

The CPU 31 then checks in step PR13 if counting of the second reference time interval TR2 is completed.

The second reference time interval TR2 represents a time interval for which the CPU 31 should perform a tone generation inhibition operation from the tone generation time by the previous performance operation until counting of the second reference time interval TR2 is completed. Therefore, if YES in step PR13, this means that peak detection at the present time $t_0$ is not at a timing during the tone generation inhibition period, and hence, the timing allows the tone generation operation.

In this case, the flow advances to step PR14, and the CPU 31 checks if the corresponding pad is subjected to tone generation within the first reference time interval TR1.

During the first reference time interval TR1, the previous performance state corresponds to the state of status "1", as has been described in (B1) and (B2) of FIG. 8. Therefore, this means that it can be determined that peak detection at the present time $t_0$ is based on the second performance operation. In this case, the flow advances to step PR15, and the CPU 31 starts counting operation of the second reference time interval TR2 so as to inhibit tone generation based on the subsequent performance operation before the counting operation of the second reference time interval TR2 is completed after the present time $t_0$.

Thereafter, the CPU 31 executes tone generation processing in step PR16, and ends the tone generation inhibition processing routine in step PR17.

However, if NO in step PR14, this means that the previous performance state before the present time $t_0$ corresponds to the state of status "0" described above with reference to (A1) and (A2) in FIG. 8, and in other words, a tone generation operation can be performed in response to the performance operation at the present time $t_0$.

The CPU 31 does not execute tone generation inhibition processing in step PR15, and the flow jumps to step PR16 to execute tone generation processing.

The principle processing sequence shown in FIG. 1B is embodied in the pad-on interrupt routine shown in FIG. 6.

[4] Principle Processing Sequence 3

A processing sequence for achieving the third object, that is, for generating a parasitic vibration produced when a plurality of performance operating members ar struck so as not to be unnatural will be briefly described below.

In the embodiment shown in FIG. 2, when one pad is struck, another pad which is not struck causes a vibration, e.g., is resonated upon influence of the one pad (i.e., causes a parasitic vibration). In this case, the CPU 31 executes small tone volume tone generation processing as tone generation (called special tone generation) different from tone generation upon normal performance (called normal tone generation) in correspondence with the parasitic vibration.

That is, when the peak interrupt signal S13 is generated due to a parasitic vibration of one of the pads PAD1 to PAD6 constituting the performance operating members 3 from another pad, the CPU 31 enters the parasitic vibration processing routine from step PR21, and fetches performance operation data (that is the peak interrupt signal S13, the pad number latch data S14, and the peak value latch data S15) from the pad causing the parasitic vibration (to be referred to as the pad of interest hereinafter) in step PR22.

Subsequently, the CPU 31 checks in step PR23 if any other pad than the pad of interest was subjected to tone generation within a predetermined reference time interval (i.e., the third reference time interval TR3). If YES in step PR23, the flow advances to step PR24 to check if a ratio of the performance operation amount of the pad of interest to the performance operation amount of another pad is equal to or larger than a predetermined value.

If YES in step PR24, this means that a vibration amount of the pad of interest has a large value based on the normal performance operation (i.e., an operation struck by a stick). In this case, the CPU 31 executes the normal tone generation operation in correspondence with the performance operation amount of the pad of interest in step PR25, and then, ends the parasitic vibration processing routine in step PR26.

However, if NO in step PR24, this means that the vibration amount of the pad of interest is considerably smaller than one based on the normal performance, and hence, it can be determined that the vibration amount is caused by a parasitic vibration.

In this case, the flow advances to step PR27, and the CPU 31 generates a musical tone in a small tone volume. Thereafter, the parasitic vibration processing routine is ended in step PR26.

As a method of special tone generation in step PR27, a musical tone is generated in a tone generation mode similar to a case wherein in a drum set as an acoustic musical instrument, a percussion of interest naturally generates a tone in a small tone volume due to resonance when another percussion is strongly struck. In this manner, a musical tone can be easily generated so as to naturally express a tone due to a parasitic vibration.

If NO in step PR23, this means that a considerable time period passed after another pad was struck. In this case, since the influence of a parasitic vibration needs not to be taken into consideration, the CPU 31 jumps the processing in step PR24, and executes the normal tone generation processing in step PR25.

Figure 1C:
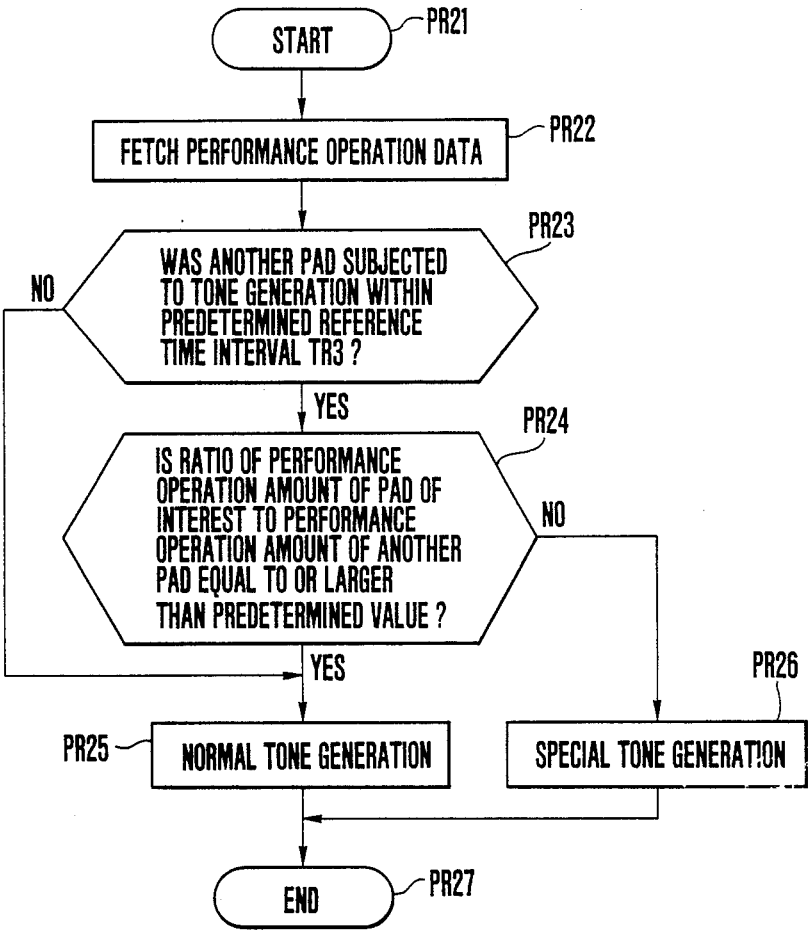

The principle processing sequence shown in FIG. 1C is embodied in the pad-on interrupt routine in FIG. 6.

[5] Timer Interrupt Processing

In (A2), (B2), and (C2) of FIG. 8, the counting operation of the lapse time data LAPCTR(i) described above is performed by executing a timer interrupt routine RT2 (FIG. 7) by the CPU 31 every time the timer interrupt signal S34 is generated from the interrupt timer 37.

When the timer interrupt signal S34 is generated, the CPU 31 writes numerical data "1" as pad number working data PN in a pad number working register REG10 (FIG. 5) in step SP1.

The pad number working data PN is used for processing the first to sixth tone generation channels one by one. The CPU 31 checks in step SP2 if the lapse time data LAPCTR(PN) (PN=1) of the tone generation channel of PN=1 is 0. If NO in step SP2, this means that the counting operation of the first or second reference time interval TR1 or TR2 is being performed for the first pad PAD1 when the timer interrupt signal S34 is generated.

The flow advances to step SP3, and the CPU 31 decrements the lapse time data LAPCTR(PN) by "1". The CPU 31 then checks in step SP4 if the lapse time data LAPCTR(PN) decremented by "1" becomes "0".

If NO in step SP4, this means that the counting operation needs to be continuously performed. In this case, the flow advances to step SP5, and the CPU 31 increments the pad number working data PN by "1", thereby designating the second tone generation channel.

If YES in step SP2, this means that the counting operation of the first or second reference time interval TR1 or TR2 has already been completed. In this case, the CPU 31 jumps steps SP3 and SP4 to step SP5.

If YES in step SP4, this means that the counting operation of the first or second reference time interval TR1 or TR2 is completed at the present time $t_0$ at which the timer interrupt signal S34 is obtained. In this case, the CPU 31 clears pad status data PDKON(PN) to 0 in step SP6, and the flow advances to step SP5.

In step SP5, the CPU 31 increments the pad number working data PN by "1" to designate the next tone generation channel. Thereafter, it is checked in step SP7 if the pad number working data PN incremented by "1" exceeds the maximum number "6" of tone generation channels.

If NO in step SP7, this means that processing for all the channel is not yet completed. In this case, the flow returns to step SP2, and the CPU 31 executes processing of the lapse time data LAPCTR(PN) (PN=2) for the new tone generation channel, i.e., PN=2.

Similarly, when the processing of the lapse time data LAPCTR(PN) for the third to sixth tone generation channels is completed, YES is obtained in step SP7, and the CPU 31 returns from step SP8 to the main routine.

In this manner, the CPU 31 executes the counting operation of the first or second reference time interval TR1 or TR2 as needed for the first to sixth tone generation channels every predetermined period of time, i.e., 1 ms.

[6] Pad-on Interrupt Processing

When the performer strikes one of the pads PAD1 to PAD6 of the performance operation unit 12, the CPU 31 executes the processing of the pad-on interrupt routine RT1 shown in FIG. 6 based on the performance operation data signal S1 obtained from the struck pad every time the peak interrupt signal S13 is detected by the peak detector 25.

More specifically, the CPU 31 enters a performance operation data fetch processing loop LP1, and fetches the pad number latch data S14 from the pad number latch 14A (FIG. 2) and writes the fetched data in the pad number register REG2 (FIG. 5) as pad number data PADNO representing the pad number data of the struck pad, in step SP11.

In step SP12, the CPU 31 fetches the peak value latch data S15 from the peak value latch 14B (FIG. 2), and writes the fetched data in the peak level register REG1 as peak level data ADVAL.

In this manner, the CPU 31 stores the data representing the number of the pad struck at the present time and its performance operation amount in the register 34A of the data/working memory 34, and then enters a previously operated pad detection processing loop LP2.

In this processing loop, the previous performance state is recognized, and it is checked whether or not a tone is generated based on performance operation data of a pad operated at the present time $t_0$. In step SP13, the CPU 31 detects a tone generation channel which has pad status data PDKON(i) of status "1" or "2" and minimum lapse time data LAPCTR(i) (i.e., channel subjected to tone generation immediately before the present time) from those other than a tone generation channel to which the pad corresponding to the pad number data PADNO fetched in the pad number register REG2 is assigned. Thereafter, in step SP13, the CPU 31 writes the lapse time data LAPCTR(i) of the corresponding tone generation channel in a previously operated pad time interval data register REG4, and writes the channel number data PADNO of the corresponding tone generation channel in a previously operated pad number register REG5 as previously operated pad number data MINPD.

Figure 9:
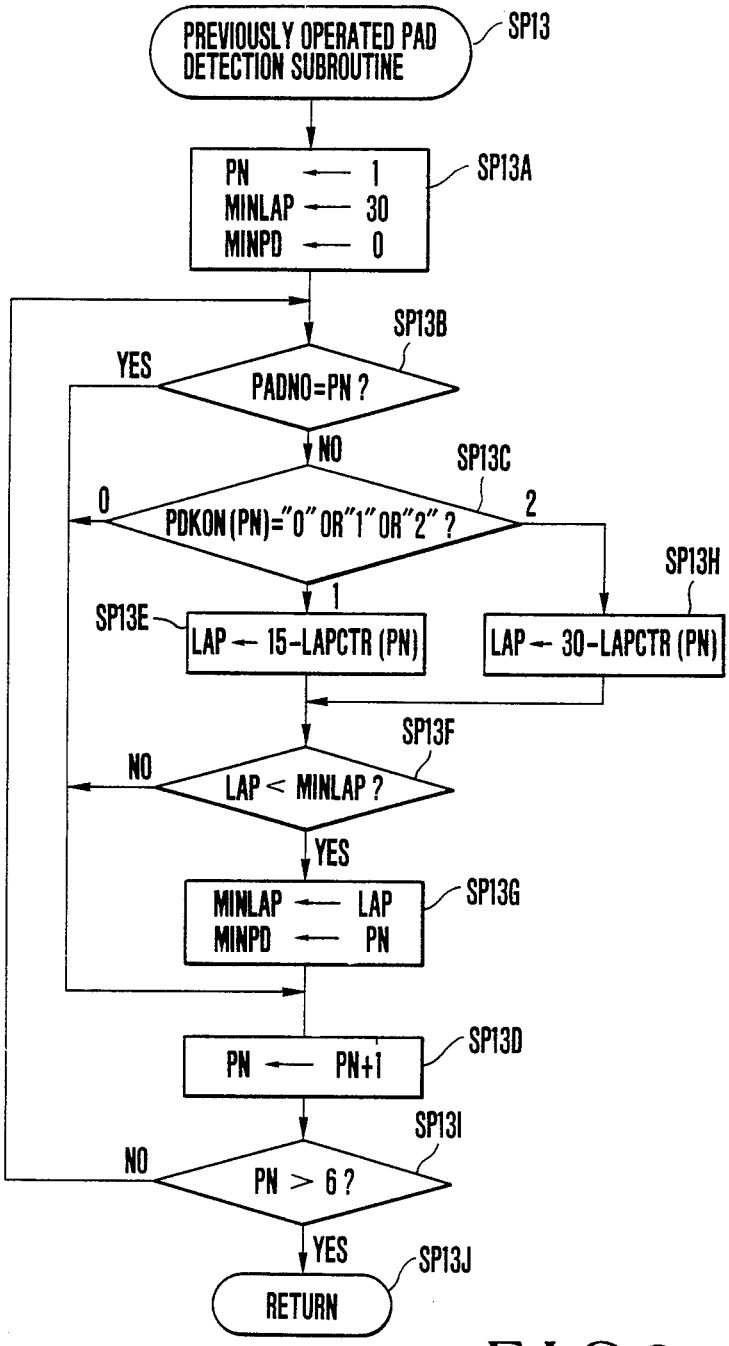
FIG. 9 is a flow chart showing detailed processing steps of step SP13 in FIG. 6.

The processing in step SP13 can be executed by using a previously operated pad detection subroutine shown in FIG. 9.

More specifically, the CPU 31 sets a value "1" as pad number working data PN, sets a value "30" as previously operated pad time interval data MINLAP, and sets a value "0" as previously operated pad number data MINPD in step SP13A. After the CPU 31 confirms in step SP13B that the pad number data PADNO is not PN (=1), it checks the content of the pad status data PDKON(PN) in step SP13C.

If the pad status data PDKON(PN) represents status "0", the flow advances to step SP13D, and the CPU 31 increments the pad number working data PN by "1".

If it can be determined in step SP13C that the pad status data PDKON(PN) represents status "1", the CPU 31 executes calculation of 15—LAPCTR(PN) in step SP13E and writes the calculation result in a lapse time detection working register REG9 as lapse time detection working data LAP. Thereafter, it is determined in step SP13F that the lapse time detection working data is smaller than the previously operated pad time interval data MINLAP. In step SP13G, the CPU 31 stores the lapse time detection working data LAP as the previously operated pad time interval data MINLAP, and stores the pad number working data PN as the previously operated pad number data MINPD.

If it is determined in step SP13F that the lapse time detection working data LAP is smaller than the previously operated pad time interval data MINLAP, the flow jumps step SP13G to step SP13D.

If it is determined in step SP13C that the pad status data PDKON(PN) represents status "2", the CPU 31 calculates 30—LAPCTR(PN) in step SP13H and stores the calculation result as the lapse time detection working data LAP.

In this manner, the CPU 31 determines that a state before the present time $t_0$ corresponds to one of status "0" ((A1) and (A2) of FIG. 8), status "1" ((B1) and (B2) of FIG. 8), and status "2" ((C1) and (C2) of FIG. 8). If the state before the present time corresponds to status "1" or "2", the CPU 31 stores the previously operated pad number data MINPD and previously operated pad time interval data MINLAP in the register 34A.

If it is determined in step SP13B that the pad number working data PN represents the pad of interest, the flow jumps to step SP13D since another channel need not be processed.

After the CPU 31 determines in step SP13I that the above-mentioned processing is executed for all the tone generation channels, the control returns from step SP13J to the pad-on interrupt routine RT1.

In this case, the CPU 31 checks in step SP14 if the previously operated pad number data MINPD is not "0". If YES in step SP14, this means that in a pad having a minimum lapse time from the previous operation and included in pads other than the presently operated pad, the first or second reference time interval TR1 or TR2 has not yet passed.

In this case, the CPU 31 checks in step SP15 if the previously operated pad time interval data MINLAP is equal to or smaller than the third reference time interval TR3 (5 ms in this embodiment).

The third reference time interval TR3 means that for a pad subjected to tone generation immediately before the present time in the first or second status, since the third reference time interval TR3 (i.e., 5 ms) or longer does not pass after the pad of interest is struck, the presently struck pad may cause parasitic vibration.

Figure 10:
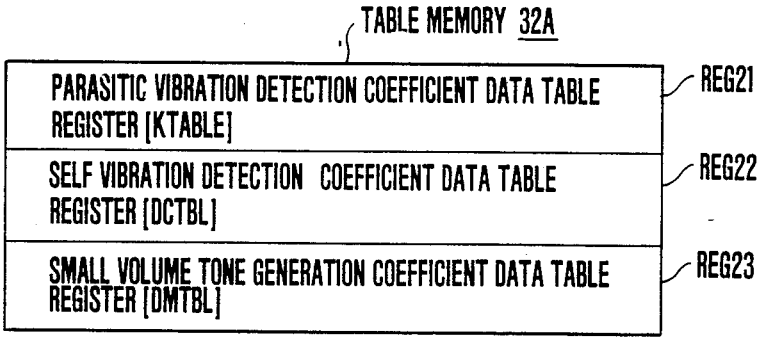
FIG. 10 is a table showing a format of a table memory of a program/table data memory 32 shown in FIG. 2.

In this case, the flow advances to step SP16, and the CPU 31 reads out parasitic vibration detection S data $K_{12}$ to $K_{65}$ from a parasitic vibration detection coefficient data table KTABLE stored in a table memory 32A (FIG. 10) of the program/table data memory 32 based on the pad number data PADNO and the previously operated pad number data MINPD, and writes the readout data in a parasitic vibration detection coefficient register REG3 of the register 34A (FIG. 5) as parasitic vibration detection coefficient data KDATA.

The parasitic vibration detection coefficient data KDATA represents the degree of influence of parasitic vibration from the pad subjected to tone generation immediately before the present time (represented by the previously operated pad number data MINPD) on the pad of interest (represented by the pad number data PADNO). For example, a coefficient value is determined based on a distance between the pad of interest struck at the present time $t_0$ and the pad subjected to tone generation immediately before the present time.

Figures 11, 12:
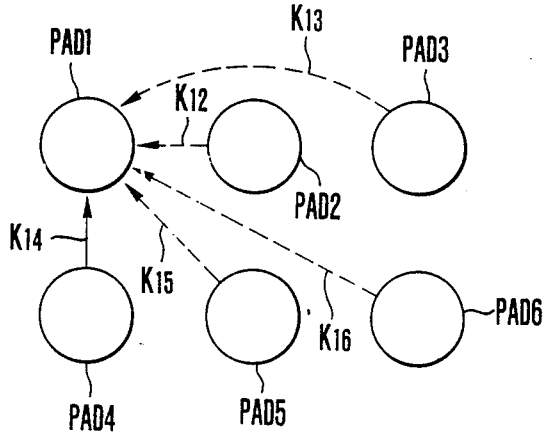
FIG. 11 is a table showing a parasitic vibration detection coefficient data table shown in FIG. 10.
FIG. 12 is a chart showing the relationship among data shown in FIG. 11 and the pads PAD1 to PAD6.

If a coefficient value determined in this manner is given by $K_{(PADNO)(MINPD)}$, the parasitic vibration detection coefficient table KTABLE can be expressed as shown in FIG. 11. For example, as shown in FIG. 12, when the first pad PAD1 is operated at the present time $t_0$, and previously operated pads are PAD2, PAD3, PAD4, PAD5, and PAD6 in the order named, their coefficient values $K_{(PADNO)(MINPD)}$ can be represented by $K_{12}$, $K_{13}$, $K_{14}$, $K_{15}$, and $K_{16}$, respectively. The coefficient values are set as follows. Since the second and fourth pads PAD2 and PAD4 are separated by substantially the same distance from the first pad PAD1, $K_{12}=K_{14}=\frac{1}{8}$. Since the fifth pad PAD5 is slightly farther than the second or fourth pad, $K_{15}=1/10$. Since the third and sixth pads PAD3 and PAD6 are located at the farthest positions, $K_{13}=K_{16}=1/16$.

In this manner, in a state wherein the pads PAD2 to PAD6 other than the pad of interest are operated immediately before the present time and are kept vibrated, the degree of influence of the vibration for the pad PAD1 operated at the present time $t_0$ is weighted to restore the optimal condition.

The CPU 31 checks in step SP17 using the parasitic vibration detection coefficient data KDATA whether or not the vibration of the pad of interest is larger than the parasitic vibration detection coefficient data KDATA.

As the present vibration state, a ratio of the peak level data ADVAL stored in the peak level register REG1 to tone generation level data DATA(MINPD) of the previously operated pad number register REG5 is used.

In the state of status "1" or "2", the peak level data ADVAL stored in the peak level register REG1 is one obtained from the pad of interest operated at the present time $t_0$, while the tone production level data ADATA(i) (i=1, 2, . . . , 6) stored in a tone production level register REG13 is peak level data for a pad which is operated immediately before the present time (this data is represented by ADATA(MINPD)). Therefore, if a peak value is detected at the present time $t_0$ from a pad which is not operated in practice, it can be considered that the peak value is generated due to parasitic vibration from the pad operated immediately before the present time. The peak level of the pad generating the peak value is assumed to be equal to or smaller than a product of $K_{(PADNO)(MINPD)}\times$(the peak level of the vibration of the pad operated immediately before the present time). The parasitic vibration detection coefficient data $K_{(PADNO)(MINPD)}$ represents a reference value of an attenuation rate of the vibration from a pad operated immediately before the present time to the pad from which the peak value is presently detected.

When the pad from which the peak is detected is actually struck, the magnitude of the vibration level, and hence, the value of the peak level data ADVAL becomes a sufficiently large value. Therefore, the ratio ADVAL/ADATA(MINPD) becomes larger than the parasitic vibration detection coefficient data KDATA.

If NO in step SP17, this means that the peak value may be caused by parasitic vibration. In this case, the CPU 31 enters a parasitic vibration processing loop LP3.

However, if YES in step SP17, this means that the generation of the peak value is caused by the actual performance operation of the pad. In this case, the CPU 31 enters a tone generation processing loop LP4.

If NO in step SP14, this means that the first reference time interval (i.e., 15 ms) or longer passes after all other pads excluding the pad generating a peak value start to generate tones. In this case, since processing for parasitic vibration needs not to be executed, the CPU 31 directly enters tone generation processing loop LP4 without executing steps SP15, SP16, and SP17.

If NO in step SP15, this means that the third reference time interval TR3 (that is, 5 ms) or longer has passed from tone generation of the previously operated pad. In this case, since there is no fear of occasion of a parasitic vibration, the CPU 31 directly enters the tone generation processing loop LP4 without executing steps SP16 and SP17.

In the tone generation processing loop LP4, the CPU 31 checks the previous operation state based on the pad status data PDKON(PADNO) of the pad number data PADNO of the pad from which the peak is detected, in step SP21.

If the pad status data PDKNO(PADNO) represents status "0", this means that tone generation is allowed any time, as has been described above with reference to (A1) and (A2) in FIG. 8. In this case, the flow advances to step SP22, and the CPU 31 rewrites the pad status data PDKON(PADNO) from status "0" to status "1", sets data of the first reference time interval TR1 (i.e., 15 ms) in the lapse time data LAPCTR(PADNO), and transfers and stores the peak level data ADVAL of the peak level register REG1 as the tone generation level data ADATA(PADNO).

In this manner, the CPU 31 switches the control condition of status "1" described above with reference to (B1) and (B2) in FIG. 8. Thereafter, the flow advances to step SP23.

In step SP23, the CPU 31 transfers the pad number data PADNO in the pad number register REG2 and the peak level data ADVAL in the peak level register REG1 together with a key-on signal KON to the tone signal generator (TG) 35 as rhythm tone generation data S31.

In this case, the tone signal generator (TG) 35 supplies, to the sound system 36, a tone signal S32 for generating a percussion tone designated by the pad number data PADNO in a tone volume designated by the peak level data ADVAL.

As described above with reference to (A1) and (A2) in FIG. 8, the CPU 31 causes to generate a percussion tone corresponding to the pad struck by the performer at the present time $t_0$, and the control returns from step SP24 to the main routine.

If the CPU 31 determines status "1" in step SP21, this means that in a state wherein a pad which is operated immediately before the present time $t_0$ during the first reference time interval TR1 before the present time $t_0$, is present, the same pad is successively struck twice, as described above with reference to (B1) and (B2) in FIG. 8.

In this case, the flow advances to step SP25, and the CPU 31 reads out self vibration detection coefficient data DCTBL (FIG. 13) from a self vibration detection coefficient data table REG22 (FIG. 10) stored in the program table data memory 32 in accordance with the tone generation level data ADATA(PADNO) and lapse time data 15-LAPCTR(PADNO) and writes the readout data in a self vibration detection data register REG8 as self vibration detection data DCVAL.

Figures 13, 14:
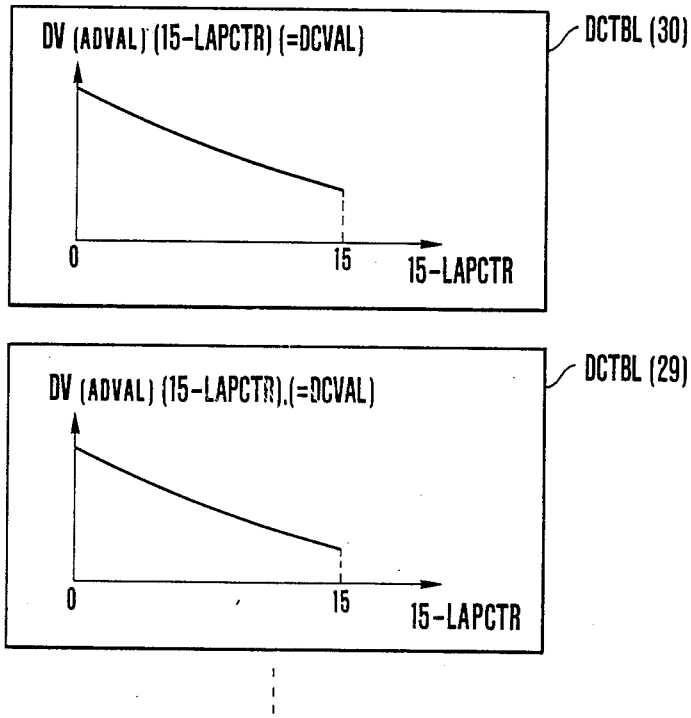
FIG. 13 is a table showing a self vibration detection coefficient data table shown in FIG. 10.
FIG. 14 is a graph showing data groups.

The data 15-LAPCTR(PADNO) represents a lapse time from the operation of the pad to the present time, and is stored as a set of data groups DCTBL(30) to DCTBL(10) in which the first reference time interval TR1 (15 ms in this embodiment) corresponds to self vibration detection coefficient data $DV_{(ADVAL)(15\text{-}LAPCTR)}$ at predetermined time intervals (e.g., 1—ms intervals) (FIG. 14).

The data groups DCTBL(30) to DCTBL(10) are prepared in correspondence with operation strengths with respect to a pad (i.e , the values 30, 29, . . . , 10 of peak level data ADVAL at the lapse time $15-LAPCTR=0$), and are constituted by data drawing an attenuation curve corresponding to the attenuation curve of the vibration of the pad.

The vibration of the pad is attenuated during the first reference time interval TR1 after the performance operation, as described above with reference to FIGS. 4A–B. However, its attenuation curve varies depending on the operation strength with respect to the pad (i.e., a strength when the pad is struck by the stick). The data groups DCTBL(30) to DCTBL(10) of the self vibration detection coefficient data table DCTBL are selected to be values smaller by a predetermined value than values at the corresponding lapse times on the attenuation curve.

When the so-called self vibration is started upon performance operation of a pad and is naturally attenuated during the first reference time interval TR1, a vibration level of the pad in the natural attenuation state is always smaller than corresponding self vibration detection coefficient data $DV_{(ADVAL)(15\text{-}LAPCTR)}$ at an arbitrary lapse time.

In this manner, the data $DV_{(ADVAL)(15\text{-}LAPCTR)}$ at the corresponding lapse time (15-LAPCTR) of the data group DCTBL(ADVAL) determined based on the peak level data ADVAL is read out from the self vibration detection coefficient data table DCTBL, and is compared with the peak level data ADVAL. In this case, if the peak level data ADVAL is larger, it can be determined that the vibration of the pad of interest is a self vibration caused by the second performance operation.

If YES in step SP26, this means that the second performance operation was made, as has been described above with reference to (B1) and (B2) in FIG. 8. In this case, the flow advances to step SP27, and the CPU 31 rewrites status "1" written as the pad status data PDKON(PADNO) corresponding to the pad from which a peak value is detected as status "2", writes a value "30" representing the second reference time interval TR2 in the lapse time data LAPCTR(PADNO), and transfers and stores the peak level data ADVAL presently stored in the peak level register REG1 as tone generation level data ADATA(PADNO).

In this manner, the CPU 31 switches the control condition of status "1" described above with reference to (B1) and (B2) in FIG. 8 to the control condition of status "2" shown in (C1) and (C2) of FIG. 8. Thereafter, the flow advances to step SP28, and supplies the pad number data PADNO in the pad number register REG2 and the peak level data ADVAL in the peak level register REG1 together with the key-on signal KON to the tone signal generator (TG) 35 as the rhythm tone generation data S31.

In this case, the tone signal generator (TG) 35 supplies, to the sound system 36, the tone signal S32 for generating a percussion tone corresponding to the pad number data PADNO in a tone volume corresponding to the peak level data ADVAL. Thereafter, the control returns from step SP29 to the main routine.

If NO in step SP26, this means that the detected peak value is lower than one obtained by the regular performance operation, e.g., abnormal vibration occurs since the first performance operation is abnormally strong. In this case, the CPU 31 causes the flow to advance to step SP29 without executing steps SP27 and SP28.

If it is determined in step SP21 that the pad status data PDKON(PADNO) represents status "2", this means that the same pad is successively struck twice during the first reference time interval TR1 before the present time $t_0$, and since the present time $t_0$ falls within the second reference time interval TR2 (=30 ms) after the second performance operation, generation of a peak value at the present time $t_0$ is abnormal, as has been described above with reference to (C1) and (C2) in FIG. 8.

In this case, the CPU 31 causes the flow to immediately return from step SP30 to the main routine. Thus, generation of the peak value is ignored, and this processing program is ended.

When the control enters the parasitic vibration processing routine LP3, the CPU 31 first checks in step SP35 if the pad status data PDKON is "0". If NO in step SP35, the pad of interest is in status "1" or "2", and hence, is kept vibrated by the first or second performance operation. In this case, the CPU 31 causes the flow to return from step SP40 to the main routine.

However, in the vibration state, even if parasitic vibration from another pad occurs, since the parasitic vibration is very small, if new special tone generation is performed based on the parasitic vibration, it sounds unnatural. Therefore, under such a status condition, special tone generation is not executed, and this processing program is ended.

If YES in step SP35, the flow advances to step SP36, and the CPU 31 reads out small volume tone generation coefficient data $D_{(PADNO)(MINPD)}$ from a small volume tone generation coefficient data table register REG23 which stores a small volume tone generation coefficient data table DMTBL in the table memory 32A (FIG. 10) using the pad number data PADNO and the previously operated pad number data MINPD a address data.

The small volume tone generation coefficient data $D_{(PADNO)(MINPD)}$ represents a coefficient for determining a tone volume when a tone is generated in a small volume depending on the pad from which a parasitic vibration is applied, when the pad of interest from which a peak value is detected is caused to generate a parasitic vibration from another pad. The small volume tone generation coefficient data $D_{(PADNO)(MINPD)}$ read out from the small volume tone generation coefficient data table DMTBL is written in a tone volume coefficient register REG6 (FIG. 5) as parasitic tone generation volume coefficient data DMRATIO.

In this embodiment, for the first pad PAD1, in FIG. 6 for example, the parasitic tone generation volume coefficient data $D_{(PADNO)(MINPD)}$ employs $D_{12}=D_{21}=1/10$ as parasitic tone generation volume data $D_{12}$ and $D_{21}$ between the first and second pads PAD1 and PAD2, employs $D_{13}=D_{31}=1/20$ as parasitic tone generation volume data $D_{13}$ and $D_{31}$ between the first and third pads PAD1 and PAD3, employs $D_{14}=D_{41}=1/10$ as parasitic tone generation volume data $D_{14}$ and $D_{41}$ between the first and fourth pads PAD1 and PAD4, employs $D_{15}=D_{51}=1/16$ as parasitic tone generation volume data $D_{15}$ and $D_{51}$ between the first and fifth pads PAD1 and PAD5, and employs $D_{16}=D_{61}=1/20$ as parasitic tone generation volume data $D_{16}$ and $D_{61}$ between the first and sixth pads PAD1 and PAD6.

In this manner, based on the fact that as a pad is closer to the pad PAD1 from which a peak value is detected, the influence of the parasitic vibration is larger, larger coefficient data is assigned as the parasitic tone generation volume coefficient data $D_{(PADNO)(MINPD)}$ as the distance is shorter. Thus, special tone generation in a tone volume which can provide a tone generation effect similar to parasitic tone generation by an acoustic instrument can be achieved.

When the processing in step SP36 is ended in step SP37, the CPU 31 multiplies the parasitic tone generation volume coefficient data DMRATIO with the peak level data ADVAL, and writes the product in the tone generation level register REG7 (FIG. 5) as tone generation level data DMADVL.

The flow then advances to step SP38, and the CPU 31 supplies the pad number data PADNO stored in the pad number register REG2 and the parasitic tone generation level data DMADVL stored in the parasitic tone generation level register REG7 together with the key-on signal KON to the tone signal generator (TG) 35 as rhythm tone generation data S31. In this case, the tone signal generator (TG) 35 supplies, to the sound system 36, the tone signal S32 for generating a special percussion tone corresponding to the pad number data PADNO in a small tone volume determined by the parasitic tone generation level data DMADVL.

In this manner, the CPU 31 ends the processing of the parasitic vibration processing loop LP3, and causes the control to return from step SP39 to the main routine.

[7]Operation of First Embodiment

With the above arrangement, when a peak value is detected at the present time $t_0$ based on the performance operation data signal S1 supplied from the pads PAD1 to PAD6, the CPU 31 controls generation of a percussion tone in different control modes in accordance with the previous operation states of the pads, i.e., status "0", status "1", and status "2".

(1) Operation for Status "0"

In this case, as has been described above with reference to (A1) and (A2) in FIG. 8, the pad of interest from which the peak value is detected within the first reference time interval TR1 before the present time $t_0$ can generate a tone whenever a performance operation is made, since no performance operation is made within the first reference time interval TR1.

In this case, the CPU 31 stores the pad number data PADNO and the peak level data ADVAL in the pad number register REG2 and the peak level register REG1, respectively, in steps SP11 and SP12 constituting the performance operation data fetch processing loop LP1 in the pad-on interrupt routine RT1 (FIG. 6). In step SP13, the CPU 31 detects the previously operated time interval data MINLAP representing an operation time interval with respect to the pad of interest and the previously operated pad number data MINPD for a pad which is other than the pad of interest and is operated immediately before the present time, and the previously operated pad number data MINPD. If the CPU 31 determines in step SP15 that the previously operated pad time interval data MINLAP is equal to or smaller than the third reference time interval TR3 (=5 ms), a parasitic vibration from the previously operated pad may occur. Therefore, in step SP16, the CPU 31 stores the parasitic vibration detection coefficient data KDATA in the parasitic vibration detection coefficient register REG3.

When a pad is regularly struck at the present time $t_0$, since the value of the peak level data ADVAL obtained from the pad of interest is considerably large, the CPU 31 detects this in step SP17, and the control enters the tone generation processing loop LP4.

Figure 17:
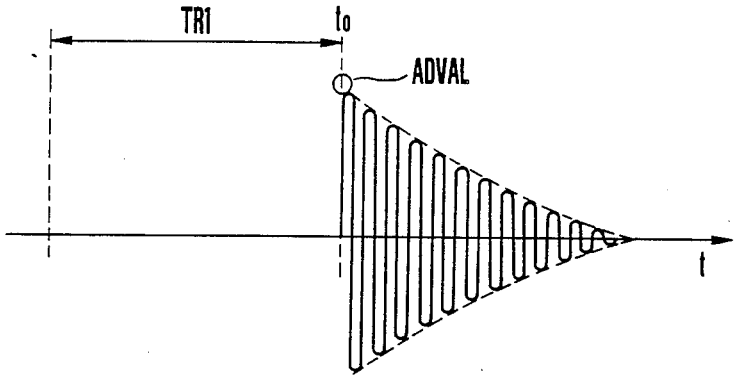

In this case, after the CPU 31 detects the status mode "0" in step SP21, it sets a value "15" of the first reference time interval TR1 (i.e., 15 ms) in the lapse time data LAPCTR(PADNO) in step SP22. In step SP23, the CPU 31 causes the tone signal generator (TG) 35 to generate a percussion tone based on the pad number data PADNO and the peak level data ADVAL, as shown in FIG. 17.

In status "0", when a pad is struck, the CPU 31 causes to immediately generate a corresponding percussion tone, and sets status "1" ((B1) and (B2) in FIG. 8) for starting a counting operation of the lapse time for the first reference time interval TR1.

(2) Operation for Status "1"

When the peak interrupt signal S13 is generated in the state of status "1", the CPU 31 detects the second peak at the present time $t_0$, causes to generate a percussion tone in correspondence with the peak detection, and starts the counting operation of the second reference time interval TR2, as has been described above with reference to (B1) and (B2) in FIG. 8.

More specifically, when the peak interrupt signal S13 is generated, the CPU 31 stores the pad number data PADNO and the peak level data ADVAL in the register 34A in the performance operation data fetch processing loop LP1 (FIG. 6), and then executes the previously operated pad detection processing loop LP2.

When peak detection at the present time $t_0$ is based on the regular performance operation with respect to the pad, the CPU 31 executes the same processing as in status "0" in the previously operated pad detection processing loop LP2, and enters tone generation processing loop LP4.

If the CPU 31 determines in step SP21 that the previous state corresponds to status "1", in step SP25, it reads out the self vibration detection coefficient data $DV_{(ADVAL)(15-LAPCTR)}$ from the self vibration detection coefficient data table DCTBL (FIGS. 13 and 14) using the tone generation level data ADATA(PADNO) and the lapse time data LAPCTR(PADNO) stored in the register 34A, and stores the readout data in the register 34A as self vibration detection coefficient data DCVAL. Thereafter, the CPU 31 compares the self vibration detection data DCVAL and the peak level data ADVAL (step SP26).

Figure 18A:
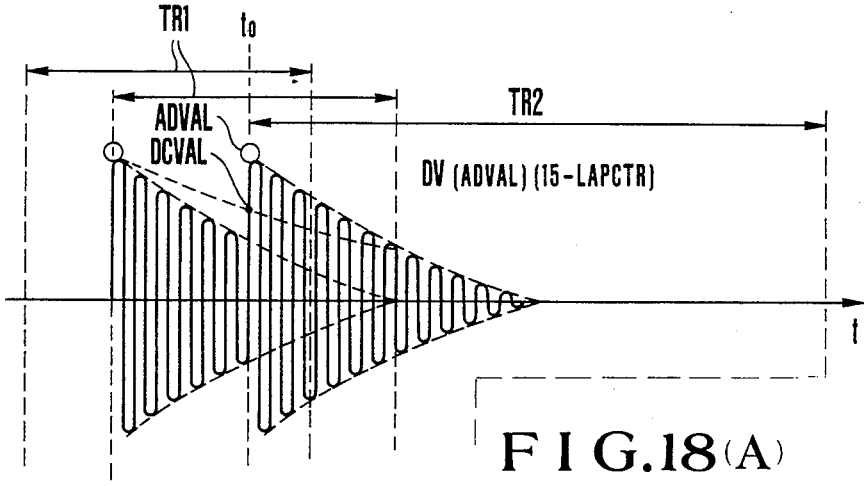
FIGS. 17, 18A–B, and 19 are waveform charts showing vibration states of status "0", status "1", and status "2", respectively.

If the peak level data ADVAL is larger, it can be determined as shown in FIG. 18A that the peak detection state at the present time $t_0$ is based on a self vibration caused by the regular performance operation of the pad of interest. The CPU 31 then generates a percussion tone designated by the pad number data PADNO in a tone volume designated by the peak level data ADVAL in steps SP27 and SP28. The CPU 31 rewrites the pad status data PDKON to status "2" data, and sets the second reference time interval TR2 (i.e., 30 ms) in the lapse time data LAPCTR(PADNO).

In this manner when the pad of interest in the state of status "1" is subjected to the second performance operation made during the first reference time interval TR1, a percussion tone corresponding to the pad is generated.

Figure 18B:
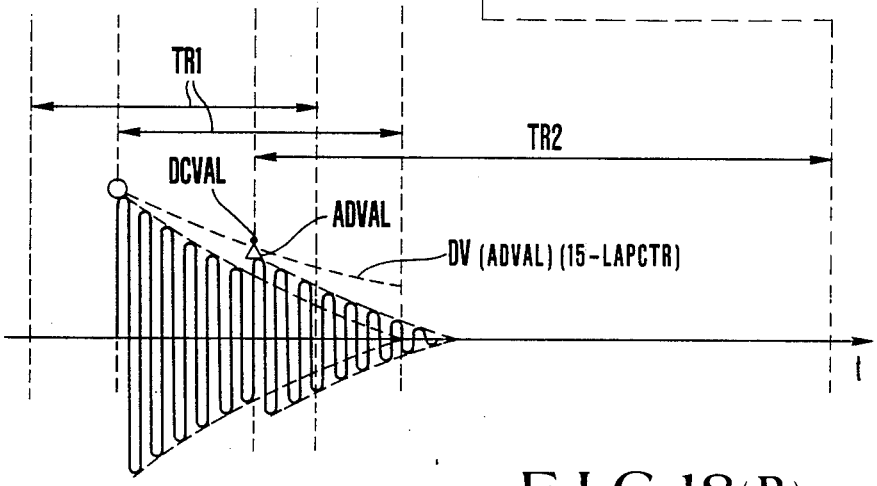

In contrast to this, for the pad of interest from which the peak value is detected, if the peak level data ADVAL is smaller than the self vibration detection data DCVAL stored in the self vibration detection data register REG8, since the peak value generated at the present time $t_0$ is not based on the self vibration, as shown in FIG. 18B, the flow pumps steps SP27 and SP28, and the CPU 31 ends the pad-on interrupt routine without generating a tone corresponding to the pad number data PADNO.

(3) Operation for Status "2"

When a peak value is detected in the state of status "2" described above with reference to (C1) and (C2) in FIG. 8, the CPU 31 executes the performance operation data processing loop LP1 and the previously operated pad detection processing loop LP2, and then, detects in step SP21 in the tone generation processing loop LP4 that the pad state corresponds to status "2".

Figure 19:
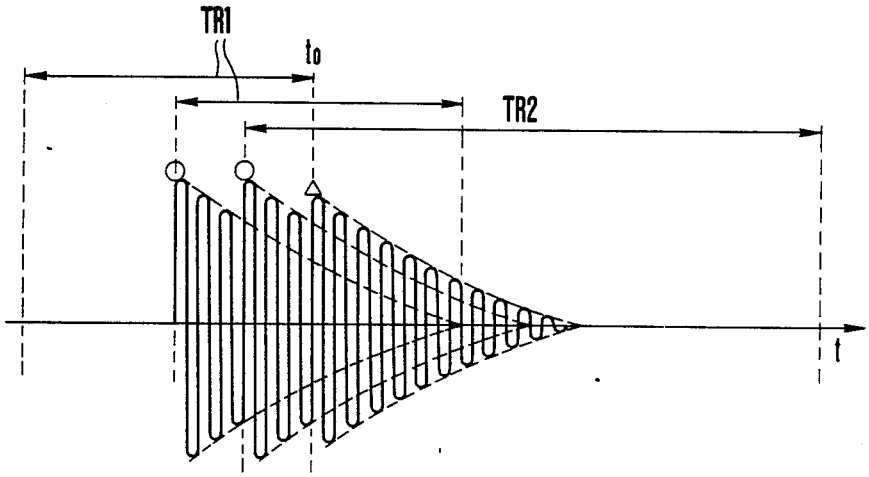

In this case, as shown in FIG. 19, the peak value detected at the present time $t_0$ is generated during the second reference time interval TR2, and is not caused by the regular performance operation with a stick. Therefore, the CPU 31 does not execute the tone generation processing, and ends the pad-on interrupt routine.

(4) Operation for Parasitic Vibration

If it is determined in the previous operation state of status "0" that the vibration of the pad from which the peak value is detected is small, the CPU 31 generates a tone in a small tone volume, thus executing special tone generation control for providing an effect similar to parasitic tone generation in an acoustic musical instrument.

More specifically, the CPU 31 fetches the pad number data PADNO and the peak level data ADVAL in the register 34A in the performance operation data fetch processing loop LP1 in the pad-on interrupt routine RT1. Thereafter, the CPU 31 determines a parasitic vibration in step SP17 in the previously operated pad detection processing loop LP2. Since the vibration (peak level data ADVAL) of the pad of interest is small, the ratio ADVAL/ADATA(MINPD) becomes smaller than the parasitic vibration detection coefficient data between the previously operated pads. More specifically, when a pad other than one from which the peak value is detected is struck, the vibration attenuated at the rate of $K_{(PADNO)(MINPD)}$ reaches the pad of interest. If the ratio of the presently generated vibration is smaller than the attenuated vibration, the parasitic vibration can be determined.

Figures 15, 16:
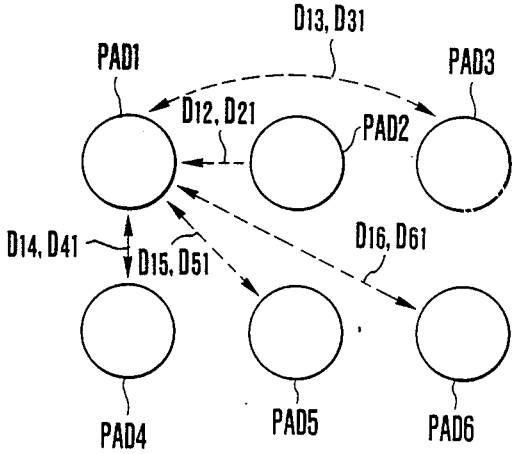
FIG. 15 is a table showing a small volume tone generation coefficient data table shown in FIG. 10.
FIG. 16 is a chart showing the relationship among the data shown in FIG. 15 and the pads PAD1 to PAD6.

In this case, in steps SP36, SP37, and SP38, the CPU 31 reads out the corresponding parasitic tone volume generation coefficient data $D_{(PADNO)(MINPD)}$ from the small volume tone generation coefficient data table DMTBL (FIG. 15), and stores the readout data in the register 34A (FIG. 5) as the parasitic tone volume generation coefficient data DMRATIO. At the same time, the CPU 31 multiplies the readout data with the peak level data ADVAL to generate parasitic tone generation level data DMADVL.

In a pad from which a peak value is detected in a state wherein no percussion tone is generated like in the previous state of status "0", a percussion tone in a small tone volume is generated like parasitic tone generation caused in an acoustic musical instrument, so that a more natural percussion tone can be generated by the sound system 36.

In contrast to this, if a peak value of a small vibration is generated in the case of status "1" or "2", the CPU 31 does not respond to this (steps SP35 and SP40), thus preventing generation of an unnatural tone.

[6] Effect of First Embodiment

According to the above-mentioned embodiment, for a pad from which a peak value of a relatively small vibration is detected in the parasitic vibration processing loop LP3 consisting of steps SP35 to SP40, this vibration is determined as a parasitic vibration, and a special tone is generated in a small tone volume so that a natural percussion tone like in an acoustic musical instrument can be generated.

In the above embodiment, in the tone generation processing loop LP4 including steps SP25, SP26, and SP27, only when the peak level data ADVAL generated when the previous state corresponds to status "1" is larger than the self vibration detection coefficient data $DV_{(ADVAL)(15\text{-}LAPCTR)}$ (i.e., the self vibration detection data DCVAL) read out from the self vibration detection coefficient data table DCTBL, a percussion tone is generated. As a result, even if a peak which would have never been generated by a given pad in a natural attenuation process is generated by the given pad, a percussion tone can be prevented from being erroneously generated based on this peak value, and erroneous tone generation can be reliably prevented.

According to the above embodiment, like in steps SP25 to SP29 and step SP30, if second tone generation is successively made after tone generation is made once in the status mode "1", the CPU 31 sets the second reference time interval TR2 (e.g., 30 ms) as the lapse time data LAPCTR(PADNO), and sets status "2" data as the pad status data PDKON(PADNO), so that generation of an unnatural percussion tone can be prevented after the pad is successively struck twice, thus preventing erroneous tone generation.

[8] Other Embodiments (1) In the above embodiment, the present invention is realized by software control. However, the present invention is not limited to this. For example, special-purpose hardware may be used.

(2) In the above embodiment, the algorithm shown in FIG. 6 is used as the pad-on interrupt routine. The algorithm representing a method of detection of the tone generation state, numerical values, and the like are not limited to those in the above embodiment, but various other algorithms and values may be employed.

(3) In the above embodiment, the present invention is applied to the electronic percussion. However, the present invention is not limited to this. For example, the present invention may be applied to an electronic percussion constituting part of an electronic or electric musical instrument, such as an auto-rhythm apparatus, an electronic keyboard, and the like.

(4) In the embodiment shown in FIG. 2, the latch register 14 for latching the pad number data S14 and the peak value latch data S15 is arranged commonly to the pads PAD1 to PAD6, and is time-divisionally operated to fetch performance operation data of the plurality of pads. Instead, various modifications may be made. For example, latch registers may be arranged in correspondence with the plurality of pads PAD1 to PAD6, and the latch data of each latch register may be processed in a predetermined priority order.

Similarly, the A/D converter 15 and the peak detector 25 may be arranged for each pad.

(5) In the above embodiment, the first, second, and third time intervals TR1, TR2, and TR3 are set to be TR1=15 ms, TR2=30 ms, and TR3=5 ms. However, the present invention is not limited to these values. For example, these time intervals may be changed within the ranges of TR1=5 to 30 ms, TR2=10 to 50 ms, and TR3=2 to 10 ms.

(6) In the above embodiment, the self vibration detection coefficient data $DV_{(ADVAL)(15\text{-}LAPCTR)}$ is read out from the self vibration detection coefficient data table DCTBL, and is stored in the self vibration detection data register REG8 as the self vibration detection data DCVAL. Instead, the self vibration detection data DCVAL may be calculated from the tone generation level data ADATA(PADNO) according to the following equation (FIG. 20):

$$DCVAL = ADATA(PADNO) - [15\text{-}LAPCTR(PADNO)] \quad (1)$$

(7) In the above embodiment, the electronic percussion 1 is arranged as shown in FIGS. 1A–C, and the plurality of pads PAD1 to PAD6 are arranged on the board 2. However, the present invention is not limited to this. The present invention may be widely applied to arrangements in which, when a plurality of pads are struck, adjacent pads are influenced by the vibration.

(8) In the embodiment of the pad-on interrupt routine RT1 shown in FIG. 6, when it is determined in step SP17 whether or not a parasitic vibration occurs, decision data KDATA is obtained by reading out radio data $K_{(PADNO)(MINPD)}$ for each pad from the parasitic vibration detection coefficient data table KTABLE (FIG. 11). Instead, identical ratio data may be used for all the pads.

(9) In the pad-on interrupt routine RT1 shown in FIG. 6, when the tone generation level data DMADVL is obtained in step SP37, the self vibration detection coefficient data table DCTBL storing the self vibration detection coefficient data $DV_{(ADVAL)(MINPD)}$ in units of pads is provided, as shown in FIG. 13, and data is read out from the self vibration detection coefficient data table DCTBL to be multiplied with the peak level data ADVAL from the pad of interest from which the peak value is detected. Instead, the peak level data may be subjected to a predetermined calculation to determine a small volume tone generation level.

(10) In the pad-on interrupt routine RT1 shown in FIG. 6, when a tone is generated in a small tone volume, the tone volume is set to be a value determined by the tone generation level data DMADVL. Instead or in addition thereto, for example, a high-frequency signal component is cut (by, e.g., a low-pass filter), so that a generated percussion tone in a small tone volume is not conspicuous, or is converted to a tone color inherent to parasitic tone generation. Thus, a tone color may be changed as needed.

When parasitic tone generation is performed, a tone generation level can be controlled by, e.g., lowering an attack rate.

(11) In the above embodiment, two tones are simultaneously generated during the first reference time interval TR1. However, the present invention is not limited to this, a plurality of tones, i.e., three or more tones may be simultaneously generated.

In this case, if pads from which peak values of a plurality of tones ar detected within the third reference time interval are present, special tone generation may be made for all the tones.

(12) In the above embodiment, the present invention is applied to an electronic percussion. However, the present invention is not limited to this. For example, the present invention may be widely applied to electronic musical instruments which operate vibrators upon performance operation, such as an electronic stringed instrument.

(13) In the above embodiment, as has been described with reference to FIGS. 18A and B, when a self vibration occurs in status "1", it is determined whether or not generation of the peak value is within the first reference time interval TR1 and the tone generation operation is performed for the second peak detection based on the self vibration detection coefficient data DCVAL in which the vibration level corresponds to the self vibration detection coefficient data $DV_{(ADVAL)(15\text{-}LAPCTR)}$ read out from the self vibration detection coefficient data table DCTBL thereby preventing erroneous tone generation based on the self vibration. Instead, as shown in FIG. 20, the self vibration detection data DCVAL may be obtained by a calculation (e.g., linear equation) using the lapse time data 15-LAPCTR(PADNO) as a variable.

(14) In order to prevent erroneous tone generation due to the self vibration, as shown in FIGS. 21A–D and 22, when a peak value is detected within a fourth reference time interval TR4, tone generation based on this may be inhibited.

Figure 22:
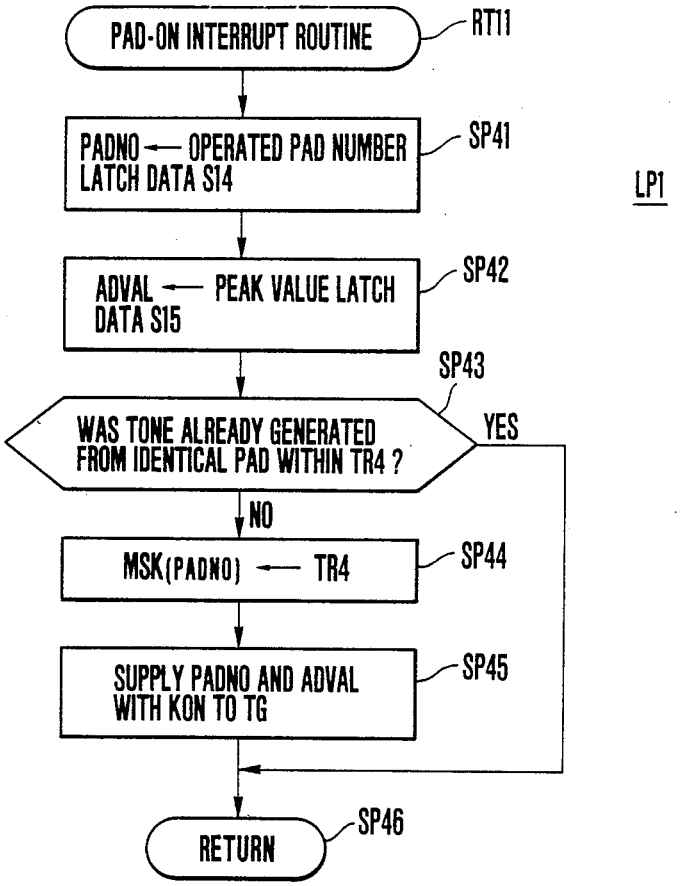

As shown in FIGS. 21A–D, in the state of status "0" before a time $t_{10}$, when the peak interrupt signal S13 is generated by the peak detector 25 as shown in FIG. 21B when a peak value is detected at the time $t_{10}$ (FIG. 21A), the CPU 31 enters a pad-on interrupt routine RT11 shown in FIG. 22, and fetches pad number latch data S14 representing the struck pad in the register 34A as pad number data PADNO. In step SP42, the CPU 31 writes the peak value latch data 14B in the register 34A as the peak level data ADVAL.

In this manner, the CPU 31 ends the performance operation data fetch processing loop LP1, and the flow advances to step SP43.

In step SP43, it is determined whether or not tone generation processing is executed for the same pad within the fourth reference time interval TR4 (e.g., 15 ms) after the present time $t_{10}$. If NO in step SP43, this means that after tone generation is made for the identical pad immediately before the present time, the fourth reference time interval TR4 does not yet pass.

The fourth reference time interval TR4 is stored in the register 34A as mask time data $MSK_{(PADNO)}$, shown in FIG. 21C and is counted by the CPU 31 in the timer interrupt routine RT2 (FIG. 7) in the same manner as the lapse time data LAPCTR(i) shown in FIG. 5.

In this case, the flow advances to step SP44, and the CPU 31 sets the fourth reference time interval TR4 in the mask time data $MSK_{(PADNO)}$. Thereafter, in step SP45, the CPU 31 supplies the pad-no data PADNO and the peak level data ADVAL together with the key-on signal KON to the tone signal generator (TG) 35, thus causing the sound system to generate a percussion tone.

In this manner, the CPU 31 ends the pad-on interrupt routine RT11, and causes the control to return from step SP46 to the main routine.

In contrast to this, as shown in FIG. 21A, when a peak value is generated at a time $t_{11}$ before the fourth reference time interval TR4 passes after the time $t_{10}$ and the peak interrupt signal S13 is generated for the pad of interest (FIG. 21B), the CPU 31 executes steps SP41 and SP42, and thereafter, obtains YES in step SP43. Thus, the CPU 31 ends the pad-on interrupt routine RT11 without executing processing in steps SP44 and SP45, and causes the control to return from step SP46 to the main routine.

In this manner, when a peak value is detected again before the fourth reference time interval TR4 (i.e., the mask time data MSK $_{(PADNO)}$) shown in FIG. 21C passes after the CPU 31 executes tone generation processing once for the same pad, the CPU 31 controls to inhibit tone generation processing for the peak detection of interest. In an electronic musical instrument for striking a pad with a single stick, even if a peak value is detected since the pad is very strongly struck, generation of an unnatural percussion tone can be prevented.

(15) In the above embodiment, the six pads PAD1 to PAD6 are arranged as the performance operating members 3. However, if the number of performance operating members 3 is one, the same effect as described above may be provided.

(16) In the above embodiment, the pads PAD1 to PAD6 as the performance operating members 3 include data associated with the strength upon performance operation. Instead, the present invention may be applied to an arrangement having a performance operation unit for detecting, based on an ON/OFF detection signal, whether or not the corresponding pad is struck.

What is claimed is:

1. An electronic musical instrument comprising:

a performance operating member, adapted for operation by a performer and responding to such operation by vibrating with an operation amount;

performance operation detection means for forming performance operation detection data corresponding to the operation amount of said performance operating member;

means for, when the performance operation detection data of said performance operating member is obtained, forming self vibration detection data, representative of residual vibration of said operating member, from a performance operation amount based on previous performance operation detection data obtained upon a previous performance operation of said performance operating member and by a first lapse time interval from when said previous performance operation detection data are obtained until a present time;

tone generation control means for comparing the performance operation detection data at the present time with said self vibration detection data, and forming, based on the comparison result, tone generation data representing whether or not tone generation is made; and tone generation means for performing a tone generation operation of a musical tone in response to said tone generation data.

2. An electronic musical instrument according to claim 1, wherein said tone generation control means outputs the tone generation data for causing said tone generation means to perform the tone generation operation when the performance operation detection data is larger than the self vibration detection data.

3. An electronic musical instrument according to claim 1, wherein said tone generation control means outputs the tone generation data for inhibiting the tone generation operation of said tone generation means when the performance operation detection data is smaller than the self vibration detection data.

4. An electronic musical instrument according to claim 1, wherein said tone generation control means comprises discrimination means for detecting whether or not the presently obtained performance operation detection data of said performance operating member is generated within a first reference time interval after the previous performance operation of said performance operating member, said discrimination means inhibiting generation of the tone generation data of said tone generation control means within a second reference time interval after the second performance operation when said discrimination means successively detects two performance operation detection data within the first reference time interval.

5. An electronic musical instrument comprising:

at least two performance operating members;

performance operation detection means for detecting performance operation detection data corresponding to operation amounts of said performance operating members;

holding means for, when first performance operation detection data is detected from one performance operating member, holding the first performance operation detection data until second performance operation detection data is obtained from the second performance operating member;

tone generation control means for forming parasitic vibration tone generation data when said first performance operation detection data held in said holding means is obtained a predetermined period of time before the second performance operation detection data is obtained and if a first performance operation amount obtained from said second performance operation detection data and a second performance operation amount obtained by said first performance operation detection data held in said holding means have a predetermined relationship corresponding to parasitic vibration of the second performance operating member; and tone generation means for generating a musical tone corresponding to the parasitic vibration tone generation data.

6. An electronic musical instrument according to claim 5, wherein the predetermined relationship is determined whether or not a ratio of the second performance operation amount to the first performance operation amount is larger than a specified value determined by the relative positions of said performance operating members.

7. An electronic musical instrument according to claim 6, wherein the performance operation amount includes peak level data.

8. An electronic musical instrument according to claim 6, wherein the coefficient value is set to be a value which is gradually decreased as the other performance operating member is separated from the one performance operating member.

9. An electronic musical instrument according to claim 5, wherein when the first performance operation amount obtained by the second performance operation detection data and the second performance operation amount obtained by the first performance operation detection data do not have the predetermined relationship, said tone generation control means generates tone generation data obtained by multiplying the first performance operation amount with a multiplier value determined by the relative positions of said performance operating members.

10. An electronic musical instrument according to claim 9, wherein the performance operation amount includes peak level data.

11. An electronic musical instrument according to claim 9, wherein the coefficient value is set to be a value which is gradually decreased as the other performance operating member is separated from the one performance operating member.

12. In an electronic musical instrument of a percussion type where percussion type musical tones are generated upon a performer striking one or more operating members, the method of reducing undesired tone generation responsive to abnormal self vibrations in the operating member, comprising the steps of:

detecting a first operation of said operating member and providing first performance data from the peak vibration amount of the operating member;

detecting a second operation of said operating member and providing second performance data from the peak vibration amount of said operating member;

forming attenuated first performance data corresponding to a natural attenuation range of the first peak vibration amount of said operating member;

comparing said second performance data with said attenuated first performance data; and based upon the comparison step generating a tone based on said second performance data or inhibiting said tone generation.

13. In an electronic musical instrument of a percussion type where percussion type musical tones are generated upon a performer striking two or more operating members, the method of providing parasitic vibration tones corresponding to parasitic vibration of a second operating member in response to striking of a first operating member configured at a predetermined distance from said second operating member, comprising the steps of:

detecting operation of said first operating member and providing first operation data representative of the vibration amount thereof;

detecting operation of said second operating member and providing second operation data representative of the vibration amount thereof;

determining the elapsed period of time between the operation of the first operating member and the operation of the second operating member;

determining, based on said elapsed period of time and the distance between said first operating member and said second operating member, whether said second operating member is undergoing parasitic vibration resulting from the operation of said first member; and generating a low volume musical tone if said determination step indicates a parasitic vibration.

* * * * *